US008815028B2

(12) United States Patent
Takahashi et al.

(10) Patent No.: US 8,815,028 B2
(45) Date of Patent: Aug. 26, 2014

(54) METHOD FOR MANUFACTURING WIRE, APPARATUS FOR MANUFACTURING WIRE, AND COPPER ALLOY WIRE

(75) Inventors: Isao Takahashi, Tokyo (JP); Keisuke Kitazato, Tokyo (JP)

(73) Assignee: The Furukawa Electric Co., Ltd, Tokyo (JP)

( * ) Notice: Subject to any disclaimer, the term of this patent is extended or adjusted under 35 U.S.C. 154(b) by 458 days.

(21) Appl. No.: 12/398,743

(22) Filed: Mar. 5, 2009

(65) Prior Publication Data

US 2009/0229715 A1 Sep. 17, 2009

Related U.S. Application Data

(63) Continuation of application No. PCT/JP2007/067335, filed on Sep. 5, 2007.

(30) Foreign Application Priority Data

Sep. 5, 2006 (JP) ..... 2006-240150
Sep. 5, 2006 (JP) ..... 2006-240151
Sep. 3, 2007 (JP) ..... 2007-228218

(51) Int. Cl.
*C21D 9/60* (2006.01)

(52) U.S. Cl.
USPC ..... 148/568

(58) Field of Classification Search
USPC ..... 148/568, 576
See application file for complete search history.

(56) References Cited

U.S. PATENT DOCUMENTS 4,732,731 A 3/1988 Asai et al.
2004/0166017 A1 8/2004 Caron et al.

FOREIGN PATENT DOCUMENTS

JP 52-24918 2/1977
JP 57-2842 1/1982
JP 62-50425 3/1987
JP 3-207842 9/1991
JP 4-293757 10/1992
JP 5-302155 11/1993
JP 6-60722 3/1994
JP 6-89620 3/1994

(Continued)

OTHER PUBLICATIONS

Sakamoto et al., English machine translation of JP 06-089620, Mar. 1994.*

(Continued)

*Primary Examiner* — Roy King
*Assistant Examiner* — Caitlin Kiechle
(74) *Attorney, Agent, or Firm* — Oblon, Spivak, McClelland, Maier & Neustadt, L.L.P.

(57) ABSTRACT

An apparatus for manufacturing wire comprising: a wire delivering equipment, a wire winding equipment, and an annealing while running equipment installed between the wire delivering equipment and the wire winding equipment, the age-precipitation copper alloy wire being passed in such manner that the wire turns around a plurality of times along a running route in the annealing while running equipment. The current applying equipment to raise a temperature of the age-precipitation copper alloy wire by generated Joule heat may be installed at upstream side of the annealing while running equipment. Another current applying equipment for solution treatment may be installed in tandem at upstream side of the annealing while running equipment. In place of the annealing while running equipment, a current applying equipment may be connected in tandem for age-treatment. By using those equipments, age-precipitation copper alloy wire having the diameter of from 0.03 mm to 3 mm may be obtained.

5 Claims, 4 Drawing Sheets

(56) References Cited

FOREIGN PATENT DOCUMENTS

| | | |
|---|---|---|
| JP | 6-158251 | 6/1994 |
| JP | 6-272003 | 9/1994 |
| JP | 10-310855 | 11/1998 |
| JP | 11-256295 | 9/1999 |
| JP | 2000-73153 | 3/2000 |
| JP | 2000-160311 | 6/2000 |
| JP | 2001-234309 | 8/2001 |
| JP | 2005-539140 | 12/2005 |

OTHER PUBLICATIONS

Kato et al., English machine translation of JP 06-158251, Jun. 1994.*
Sakamoto et al., English translation of JP 06-089620, Mar. 1994, p. 1-15.*
Kato et al., English translation of JP 06-158251, Jun. 1994, p. 1-20.*
Notice for a Reason of Rejection issued Jan. 11, 2013 in Japanese Patent Application No. 2007-228218 (with English translaiton).

* cited by examiner

METHOD FOR MANUFACTURING WIRE, APPARATUS FOR MANUFACTURING WIRE, AND COPPER ALLOY WIRE

FIELD OF THE INVENTION

The present invention relates to a method for manufacturing wire, an apparatus for manufacturing wire, and copper alloy wire, the wire of which is used for a wiring material applied to an automobile and robot, a lead wire applied to electronic devices, a connector pin, coil spring or the like.

BACKGROUND OF THE INVENTION

As a wiring material applied to an automobile, there has been used an electrical wire in which a conductor made of a twisted wire of soft copper wire is concentrically covered by an insulator. In this field, the amount of the electric wire is increased to satisfy various desired high level functions of the automobile, thus the weight of the electric wire increases. On the other hand, a lighter body of the vehicle is desired, and thinner diameter as well as higher strength of the wire conductor is desired and required.

Precipitation-type alloy wire may be listed as the wire conductor having excellent mechanical and electrical property in order to satisfy the above requirement. When the aging precipitation-type alloy wire is subjected to an aging heat treatment, a certain time period is required to cause the precipitation. Generally, the following furnaces are used:

(1) batch-type annealing furnace (bell type, pot type)

(2) continuous batch-type annealing furnace (bulkhead type, roller hearth type)

Since the wire is wound around the spool and heat-treated in the furnace, or the wire is prepared as stand type or bundle type and heat-treated in the furnace, the productivity of the wire is low in comparison with a continuous annealing apparatus for a single wire.

As a method for annealing wire with high productivity, there are an annealing method in which the wire is continuously passed through a heated annealing furnace, and an annealing method in which current is applied to the wire to generate Joule heat, thereby annealing the wire per se. In both of the above methods, the heat treatment is carried out at a high temperature and for a short time such that the wire may not be subjected to the aging heat treatment.

For example, Japanese Patent Application Publication No. 11-256295 discloses a method for age-treating Cu—Zr alloy while the alloy is passed through a furnace. Japanese Patent Application Publication No. 2000-160311 discloses a method for age-treating Cu—Zr alloy by applying current to the alloy to generate Joule heat.

[Patent document 1] Japanese Patent Application Publication No. 11-256295

[Patent document 2] Japanese Patent Application Publication No. 2000-160311

DISCLOSURE OF THE INVENTION

Problems to be Solved

In the method for age-treating Cu—Zr alloy while the alloy is passed through a furnace, the time for heat treating the alloy within the furnace is 1 to 10 seconds. Such a short time makes it impossible to perform the age-treatment of the usual precipitation-type alloy. In the method for age-treating Cu—Zr alloy by applying current to the alloy to generate Joule heat, the time for heat treating the alloy within the furnace is 0.3 to 4 seconds. Such a short time makes it impossible to perform the age-treatment of the usual precipitation-type alloy.

Further, higher cost is needed for the equipment in the above described batch-type annealing furnace, or the continuous batch-type annealing furnace, and vast space is needed for installing the furnace. In addition, the furnace may not be installed in tandem with a wire twisting machine, for example (i.e., equipments are installed in a cascaded manner and the wire is passed therethrough to continuously perform a plurality of processes as one processing step). More specifically, the annealing makes one processing step. Furthermore, when the temperature of the annealing is high, adjacent wires are likely stuck together to cause surface defects upon sending in the next processing step. As described above, time for annealing is so short to perform the age-treatment in the conventional annealing methods.

An object of the present invention is to provide an apparatus for manufacturing wire and a method for manufacturing wire which can apply aging treatment by continuous annealing, and the wire of which is used for a conductor of a wiring material or the like.

Means to Solve the Problems

In order to solve the above described problems, the inventors have intensively studied. As a result, it has been found that if the wire passing through an annealing while running equipment stays longer within the annealing while running equipment, i.e., if the wire is passed in such manner that the wire turns around a plurality of times along a running route in the annealing while running equipment to extend the time period of staying therein, the wire may be held for the time period and at the prescribed temperature necessary for age-treatment, thus enabling the wire to be subjected to age-treatment by continuous annealing.

Furthermore, it has been found that a plurality of current applying equipments are installed in tandem with a prescribed interval within the annealing while running equipment, and the wire is heated in the respective current applying equipments while lowering the temperature of the wire in no current applying region between the adjacent current applying equipments, the wire may be maintained at the temperature between an upper limit of age-precipitation and a lower limit of age-precipitation for a time period necessary for the age-treatment, thus enabling the wire to be subjected to the age-treatment by continuous annealing.

In addition it has been found that if a current applying equipment for exclusively solution purpose is connected in tandem at upstream side of the annealing while running equipment, it becomes possible to continuously perform solution-aging process. Furthermore, it has been found that with drawing equipment combined, it becomes possible to continuously perform such processes as solution-drawing-aging process, solution-aging-drawing process, solution-drawing-aging-drawing or the like process, thus obtaining various kind of materials. The present invention is made on the basis of the above described results.

The first embodiment of the method for manufacturing wire of the invention is a method for manufacturing wire comprising the steps of:

delivering an age-precipitation copper alloy wire;

heating the delivered wire while running to be subjected to aging treatment; and winding the wire with the aging treatment thus applied.

In the second embodiment of the method for manufacturing wire, in said aging treatment while running, the delivered wire is passed in such manner that the wire turns around a plurality of times along a running route of the heating while being maintained for a prescribed time period and within a prescribed temperature range.

In the third embodiment of the method for manufacturing wire, said aging treatment is carried out at a temperature from 300 degrees Celsius to 600 degrees Celsius and for a time period of over 10 seconds to 1200 seconds.

In the fourth embodiment of the method for manufacturing wire, the method further comprises the step of applying current to the wire to be heated by generated Joule heat prior to said aging treatment.

In the fifth embodiment of the method for manufacturing wire, in the step of applying current to the wire, the wire is heated at a temperature from 300 degrees Celsius to 600 degrees Celsius for a time period of up to 5 seconds.

In the sixth embodiment of the method for manufacturing wire, the method further comprises the step of applying solution treatment to the wire prior to said applying current to the wire.

In the seventh embodiment of the method for manufacturing wire, in said aging treatment, the delivered wire is passed through respective at least one different current applying regions, and no current applying region between said current applying regions in which a temperature of the wire is lowered, while the wire is maintained within a prescribed temperature range.

In the eighth embodiment of the method for manufacturing wire, said different current applying region comprises a temperature raised current applying region in which the temperature of the wire is raised to a prescribed temperature and a temperature maintained current applying region in which the temperature of the wire is maintained within a prescribed temperature range, and the temperature of the wire is maintained between an upper limit of aging temperature and a lower limit of aging temperature.

In the ninth embodiment of the method for manufacturing wire, said aging treatment is carried out at a temperature from 300 degrees Celsius to 600 degrees Celsius and for a time period of over 10 seconds to 1200 seconds.

In the tenth embodiment of the method for manufacturing wire, the method further comprises the step of applying solution treatment to the wire prior to said aging treatment.

In the eleventh embodiment of the method for manufacturing wire, said solution treatment is carried out at a temperature of at least 800 degrees Celsius and for a time period of up to 5 seconds.

In the twelfth embodiment of the method for manufacturing wire, said wire has a diameter of from 0.03 mm to 3 mm.

In the thirteenth embodiment of the method for manufacturing wire, said wire comprises a twisted wire.

The first embodiment of the apparatus for manufacturing wire is an apparatus for manufacturing wire comprising:

a wire delivering equipment;

a wire winding equipment;

an annealing while running equipment installed between said wire delivering equipment and said wire winding equipment, wherein age-precipitation copper alloy wire is passed through said annealing while running equipment while a temperature of the wire is maintained between an upper limit of aging temperature and a lower limit of aging temperature.

In the second embodiment of the apparatus for manufacturing wire, the wire is substantially constantly heated in a longitudinal direction thereof in said annealing while running equipment, and the wire is passed in such manner that the wire turns around a plurality of times along a running route in said annealing while running equipment.

In the third embodiment of the apparatus for manufacturing wire, the wire is held at a temperature from 300 degrees Celsius to 600 degrees Celsius and for a time period of over 10 seconds to 1200 seconds in said annealing while running equipment.

In the fourth embodiment of the apparatus for manufacturing wire, the apparatus further comprises a current applying equipment to raise a temperature of the wire by generated Joule heat at upstream side of said annealing while running equipment.

In the fifth embodiment of the apparatus for manufacturing wire, the wire is heated at a temperature from 300 degrees Celsius to 600 degrees Celsius and for a time period of up to 5 seconds in said current applying equipment.

In the sixth embodiment of the apparatus for manufacturing wire, the apparatus further comprises a solution treatment equipment to apply solution treatment to the wire at upstream side of said annealing while running equipment.

In the seventh embodiment of the apparatus for manufacturing wire, the wire is heated at a temperature of at least 800 degrees Celsius and for a time period of up to 5 seconds in said solution treatment equipment.

In the eighth embodiment of the apparatus for manufacturing wire, said annealing while running equipment includes a plurality pairs of guide rolls inside thereof, and said wire is passed in such manner that the wire turns around a plurality of times between the guide rolls.

In the ninth embodiment of the apparatus for manufacturing wire, said annealing while running equipment comprises a plurality of current applying equipments to raise a temperature of the wire by generated Joule heat, and the wire is passed through the plurality of current applying equipments in sequence while the temperature of the wire is maintained at a temperature between an upper limit of aging temperature and a lower limit of aging temperature.

In the tenth embodiment of the apparatus for manufacturing wire, the temperature of the wire between the plurality of current applying equipments is configured to be over the lower limit of the aging temperature.

In the eleventh embodiment of the apparatus for manufacturing wire, the wire is held at a temperature from 300 degrees Celsius to 600 degrees Celsius and for a time period of over 10 seconds to 1200 seconds in said annealing while running equipment.

In the twelfth embodiment of the apparatus for manufacturing wire, said plurality of current applying equipments comprises at least one temperature raise current applying equipment and at least one temperature maintaining current applying equipment, and the temperature of the wire is raised to a prescribed temperature by said temperature raise current applying equipment, while the temperature of the wire is maintained between an upper limit of the aging temperature and a lower limit of the aging temperature by said temperature maintaining current applying equipment.

In the thirteenth embodiment of the apparatus for manufacturing wire, said temperature raise current applying equipment and said temperature maintaining current applying equipment respectively include a guide roll to apply current to the wire.

In the fourteenth embodiment of the apparatus for manufacturing wire, the apparatus further comprises a solution treatment equipment to apply solution treatment to the wire at upstream side of said annealing while running equipment.

In the fifteenth embodiment of the apparatus for manufacturing wire, the wire is heated in said solution treatment equipment at a temperature of at least 800 degrees Celsius and for a time period of up to 5 seconds.

In the sixteenth embodiment of the apparatus for manufacturing wire, the wire passing through said annealing while running equipment has a diameter of from 0.03 mm to 3 mm.

In the seventeenth embodiment of the apparatus for manufacturing wire, the wire passing through said annealing while running equipment comprises a twisted wire.

The first embodiment of the copper alloy wire of the invention is a copper alloy wire manufactured by the steps of forming age-precipitation copper alloy to a copper alloy wire having a diameter from 0.03 mm to 3 mm, and subjecting the copper alloy wire to aging treatment.

The second embodiment of the copper alloy wire of the invention is a copper alloy wire manufactured by the steps of subjecting age-precipitation copper alloy to a solution treatment, draw-forming the copper alloy to a copper alloy wire having a diameter from 0.03 mm to 3 mm, and then subjecting the copper alloy wire to aging treatment.

The third embodiment of the copper alloy wire of the invention is a copper alloy wire manufactured by the steps of forming age-precipitation copper alloy to a copper alloy wire having a diameter from 0.03 mm to 3 mm, twisting a plurality of the copper alloy wires and subjecting the copper alloy wires to aging treatment.

The fourth embodiment of the copper alloy wire of the invention is a copper alloy wire manufactured by the steps of subjecting age-precipitation copper alloy to a solution treatment, draw-forming the copper alloy to a copper alloy wire having a diameter from 0.03 mm to 3 mm, twisting a plurality of the copper alloy wires and then subjecting the copper alloy wires to aging treatment.

In the fifth embodiment of the copper alloy wire, said age-precipitation copper alloy comprises Cu—Ni—Si copper alloy consisting essentially of Ni: 1.5 to 4.0 mass %, Si: 0.3 to 1.1 mass %, and the balance being copper and inevitable impurities.

In the sixth embodiment of the copper alloy wire, said age-precipitation copper alloy comprises Cu—Ni—Si copper alloy consisting essentially of Ni: 1.5 to 4.0 mass %, Si: 0.3 to 1.1 mass %, at least one element selected from a group of Ag, Mg, Mn, Zn, Sn, P, Fe, Cr and Co: 0.01 to 1.0 mass %, and the balance being copper and inevitable impurities.

In the seventh embodiment of the copper alloy wire, said age-precipitation copper alloy comprises Cu—Cr copper alloy consisting essentially of Cr: 0.1 to 1.5 mass %, and the balance being copper and inevitable impurities.

In the eighth embodiment of the copper alloy wire, said age-precipitation copper alloy comprises Cu—Cr copper alloy consisting essentially of Cr: 0.1 to 1.5 mass %, at least one element selected from a group of Zn, Sn and Zr: 0.1 to 1.0 mass %, and the balance being copper and inevitable impurities.

In the ninth embodiment of the copper alloy wire, said age-precipitation copper alloy comprises Cu—Ti copper alloy consisting essentially of Ti: 1.0 to 5.0 mass %, and the balance being copper and inevitable impurities.

In the tenth embodiment of the copper alloy wire, said age-precipitation copper alloy comprises Cu—Fe copper alloy consisting essentially of Fe: 0.1 to 3.0 mass %, and the balance being copper and inevitable impurities.

In the eleventh embodiment of the copper alloy wire, said age-precipitation copper alloy comprises Cu—Fe copper alloy consisting essentially of Fe: 0.1 to 3.0 mass %, at least one element selected from a group of P and Zn: 0.01 to 1.0, and the balance being copper and inevitable impurities.

In the twelfth embodiment of the copper alloy wire, said age-precipitation copper alloy comprises Cu—Ni—Ti copper alloy consisting essentially of Ni: 1.0 to 2.5 mass %, Ti: 0.3 to 0.8 mass %, and the balance being copper and inevitable impurities.

In the thirteenth embodiment of the copper alloy wire, said age-precipitation copper alloy comprises Cu—Ni—Ti copper alloy consisting essentially of Ni: 1.0 to 2.5 mass %, Ti: 0.3 to 0.8 mass %, at least one element selected from a group of Ag, Mg, Zn and Sn: 0.01 to 1.0 mass %, and the balance being copper and inevitable impurities.

Effect of the Invention

According to the method for manufacturing wire of the invention, it is possible to carry out aging heat treatment by continuous annealing. Furthermore, since the annealing while running equipment can be installed in tandem with various continuous equipment (for example, wire twisting equipment, covering equipment, drawing equipment), the number of the processes can be reduced.

In addition, when a current applying equipment for exclusively solution purpose is connected in tandem at upstream side of the annealing while running equipment, it becomes possible to continuously perform solution-aging process. Furthermore, with drawing equipment combined, it becomes possible to continuously perform such processes as solution-drawing-aging process, solution-aging-drawing process, solution-drawing-aging-drawing or the like process, thus obtaining various kinds of materials.

Furthermore, the copper alloy wire of the invention can be preferably obtained by the above described manufacturing method when the diameter of the wire is of from 0.03 mm to 3 mm.

DESCRIPTION OF NUMERAL REFERENCE

Figure 1:
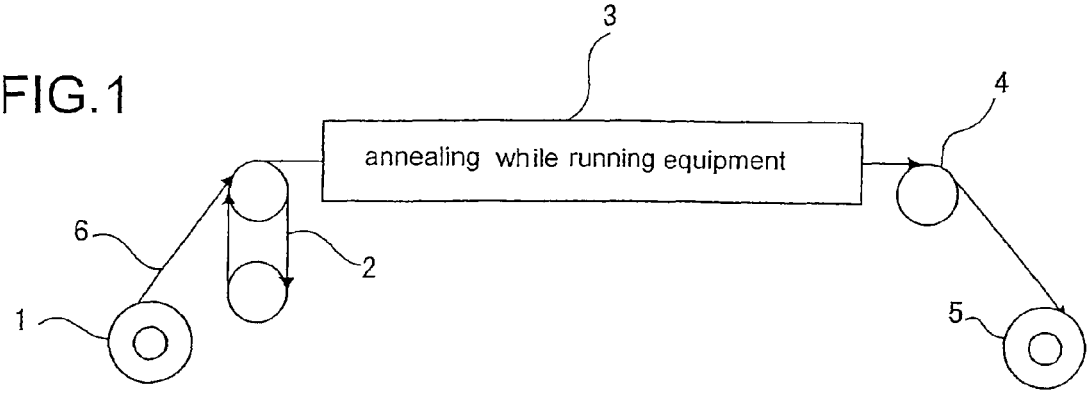
FIG. 1 is a schematic view to explain one embodiment of an annealing while running equipment of the invention.

1, 11 wire delivering equipment
2, 12 dancer equipment
3 annealing while running equipment
4, 14 pulling capstan
5, 15 wire winding equipment
6, 16 wire
7 guide roll
8 current applying equipment (pre-heating equipment)
13 heating while running equipment

17 guide roll
18 power source
19 current applying equipment for raising the temperature
20 current applying equipment for maintaining the temperature

| DESCRIPTION OF NUMERAL REFERENCE | |
|---|---|
| 1, 11 | wire delivering equipment |
| 2, 12 | dancer equipment |
| 3 | annealing while running equipment |
| 4, 14 | pulling capstan |
| 5, 15 | wire winding equipment |
| 6, 16 | wire |
| 7 | guide roll |
| 8 | current applying equipment (pre-heating equipment) |
| 13 | heating while running equipment |
| 17 | guide roll |
| 18 | power source |
| 19 | current applying equipment for raising the temperature |
| 20 | current applying equipment for maintaining the temperature |

MOST PREFERABLE EMBODIMENT TO PERFORM THE INVENTION

The apparatus for manufacturing wire and the method for manufacturing wire of the invention are described in detail with reference to the drawings.

A basic embodiment of the apparatus for manufacturing wire of the invention is an apparatus for manufacturing wire comprising: a wire delivering equipment; a wire winding equipment; an annealing while running equipment installed between said wire delivering equipment and said wire winding equipment, wherein age-precipitation copper alloy wire is passed through said annealing while running equipment while a temperature of the wire is maintained between an upper limit of aging temperature and a lower limit of aging temperature. In addition, a basic embodiment of the method for manufacturing wire is the method for manufacturing wire comprising the steps of: delivering an age-precipitation copper alloy wire; heating the delivered wire while running to be subjected to aging treatment; and winding the wire with the aging treatment thus applied. The specific embodiments are described hereunder.

One embodiment of the apparatus for manufacturing wire of the invention is an apparatus for manufacturing wire comprising: a wire delivering equipment; a wire winding equipment; an annealing while running equipment installed between said wire delivering equipment and said wire winding equipment, wherein age-precipitation copper alloy wire is passed through said annealing while running equipment while a temperature of the wire is maintained between an upper limit of aging temperature and a lower limit of aging temperature. The wire is substantially constantly heated in a longitudinal direction thereof in the annealing while running equipment, and the wire is passed in such manner that the wire turns around a plurality of times along a running route in the annealing while running equipment.

Furthermore, the apparatus may includes a current applying equipment in tandem to raise a temperature of the age-precipitation copper alloy wire by generated Joule heat at upstream side of the annealing while running equipment. The current applying equipment pre-heats the wire to be delivered into the annealing while running equipment at the temperature between the upper limit of aging temperature and the lower limit of aging temperature.

Furthermore, the apparatus may includes current applying equipment (a solution treatment equipment) in tandem to apply solution treatment to the age-precipitation copper alloy wire at upstream side of the annealing while running equipment (if the apparatus includes current applying equipment at upstream side of the annealing while running equipment, includes the same further upstream side thereof).

The upstream side means the side of delivering the wire and the downstream side means the side of winding the wire.

FIG. 1 is a schematic view to explain one embodiment of an annealing while running equipment of the invention. As shown in FIG. 1, an apparatus for manufacturing wire includes a wire delivering equipment 1, a wire winding equipment 5, an annealing while running equipment 3 installed between the wire delivering equipment 1 and the wire winding equipment 3. The annealing while running equipment 3 is configured to be in that an age-precipitation copper alloy wire is passed in such manner that the wire turns around a plurality of times along a running route.

In the method for manufacturing wire of the invention as shown in FIG. 1, to secure a time for heat treatment (i.e., a time for age-treatment), the wire is turned plurality of times to change the direction within the annealing while running equipment 3, thus holding the wire for longer time than the conventional art to conduct a prescribed age-treatment for the wire. More specifically, the wire is sufficiently age-treated.

The annealing while running equipment means the apparatus in which the wire is heated while being passed at a prescribed speed to be annealed. In connection with this embodiment, the annealing while running equipment 3 is preferably the equipment in which the wire passing through the inside of the equipment is heated at substantially constant temperature along the longitudinal direction. Specifically, the annealing while running equipment 3 is the equipment in which the wire is age-treated so that the wire is held at the prescribed temperature. Such indirect heating equipment as an induction heating equipment or the like is favorably used as the annealing while running equipment.

As shown in FIG. 1, the tensile force of the wire 6 delivered by the wire delivering equipment 1 is stabled by so-called dancer-equipment 2. Then, the wire 6 passes through the inside of the annealing while running equipment 3, is heated (annealed) therein at a prescribed temperature, and wound through a pulling capstan 4 by the wire winding equipment 5.

Figure 2:
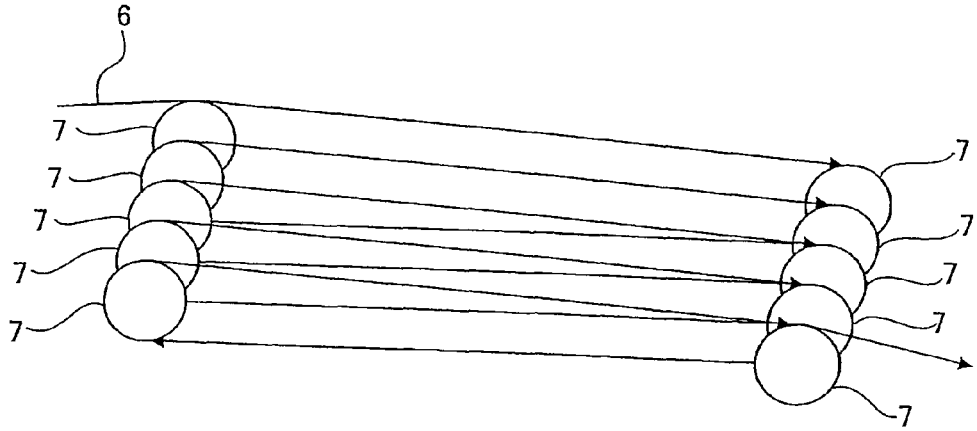
FIG. 2 is a schematic view to show one example of the internal structure of the annealing while running equipment 3 as shown in FIG. 1.

FIG. 2 is a schematic view to show one example of the internal structure of the annealing while running equipment 3 as shown in FIG. 1. As shown in FIG. 2, a plurality pairs of guide rolls 7 are arranged at the both end portions of the annealing while running equipment 3, i.e., the inlet side of the wire (the side from which the wire is delivered), and the outlet side of the wire (the side to which the wire is wound). The number of the plurality pairs of the guide rolls 7 may be at least two. The wire 6 enters from the wire delivering equipment 1 into the annealing while running equipment 3 turns the direction at least two times within the annealing while running equipment 3, and runs out of the annealing while running equipment 3. Thus, the wire stays for longer time within the annealing while running equipment 3 to realize sufficient precipitation to improve the strength of the wire.

In this case, the wire 6 is held at the temperature of the inside of the annealing while running equipment 3. The time of the heat treatment may be changed by the number of turns or the speed of the line within the annealing while running equipment 3. The temperature within the annealing while running equipment (i.e., furnace temperature) may be appropriately changed.

In general, the temperature within the annealing furnace is set higher than the target temperature of the wire in the annealing while running equipment, so that the temperature of the wire rises after a short period of time. When the temperature of the wire reaches the target temperature, the wire is cooled. The heat treatment which is expected for this case is re-crystallization heat treatment and low temperature annealing. On the other hand, the heat treatment which is expected in the present invention is the age-treatment, where the wire is held at a certain temperature, so that the temperature of the inside of the furnace is not set to be high, thus it takes time to raise the temperature of the wire. To shorten the time, there is available a method using current applying to raise the temperature of the wire, however, by the current applying method, as the time applying current becomes longer, the temperature of the wire becomes higher. An attempt is needed to maintain the temperature of the wire below the upper limit of the aging temperature.

The heating of the wire by current applying means that the current is directly applied to the wire through metal contacts such as roller, pulley or the like, or the current is indirectly generated by the induction coil and applied to the wire so that the Joule heat generated by the electric resistance of the wire rises the temperature and heat the wire itself.

The apparatus may includes a current applying equipment in tandem to raise a temperature of the age-precipitation copper alloy wire at upstream side of the annealing while running equipment.

Figure 3:
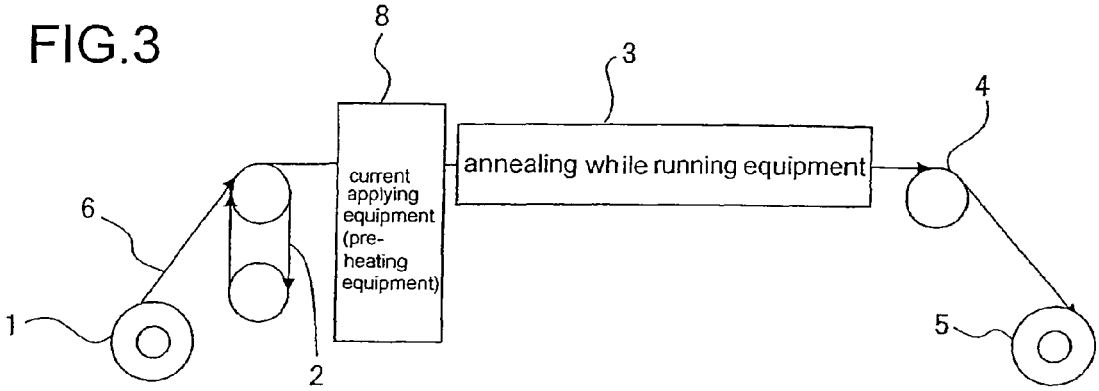
FIG. 3 is a schematic view to explain a method for manufacturing wire of other embodiment of the invention.

FIG. 3 is a schematic view to explain a method for manufacturing wire of other embodiment of the invention. As show in FIG. 3, the apparatus may includes a current applying equipment 8 in prior to (i.e., upstream side) of the annealing while running equipment 3.

The current applying equipment 8 pre-heats the wire 6 to be delivered into the annealing while running equipment 3 at the temperature between the upper limit of aging temperature and the lower limit of aging temperature. Since the current applying equipment 8 heats the wire 6 at the temperature between the upper limit of aging temperature and the lower limit of aging temperature, the age-treatment is substantially started when the temperature of the wire reaches the lower limit of the aging temperature in the current applying equipment 8. Furthermore, if the current applying equipment 8 is installed at the upstream side of the annealing while running equipment 3, the time for applying current becomes longer toward the downstream side of the current applying equipment 8 to cause the temperature of the wire to be higher. Thus, the temperature of the wire delivered from upstream side of the annealing while running equipment is enabled to close to a desired temperature between the upper limit of the aging temperature and the lower limit of the aging temperature.

As shown in FIG. 3, the tensile force of the wire 6 delivered by the wire delivering equipment 1 is stabled by so-called dancer-equipment 2. Then, current is applied to the wire 6 by the current applying equipment 8 (pre-heating equipment), and the temperature of the wire is raised to a prescribed temperature between the upper limit of aging temperature and the lower limit of ageing temperature by the Joule heat. The wire with the temperature raised to the prescribed temperature is passed through the annealing while running equipment 3 to be annealed at the desired temperature, and wound through a pulling capstan 4 by the wire winding equipment 5.

The heat treatment which is expected in the annealing while running equipment is the age-treatment, where the wire is held at a certain temperature, so that the temperature of the inside of the furnace is not set to be high, thus it takes time to raise the temperature of the wire. To shorten the time, the current applying equipment (i.e., pre-heating equipment) 8 is installed at the upstream side of the annealing while running equipment 3. According to the apparatus for manufacturing wire of this embodiment, the temperature of the wire is raised to a desired temperature between the upper limit of aging temperature and the lower limit of aging temperature by the generated Joule heat so that the temperature of the wire is raised close to the age-treatment temperature following the age-treatment in the annealing while running equipment 3.

Further, a solution treatment may be applied prior to the age-treatment. The current applying equipment is favorably used for the equipment for applying the solution treatment, however, other heating equipment such as induction heating equipment may be used. By this arrangement, the solution treatment and the age-treatment may be continuously carried out. Wire drawing machine is further arranged to enable to manufacture the wire having a desired diameter and property by continuous treatment.

Figure 4:
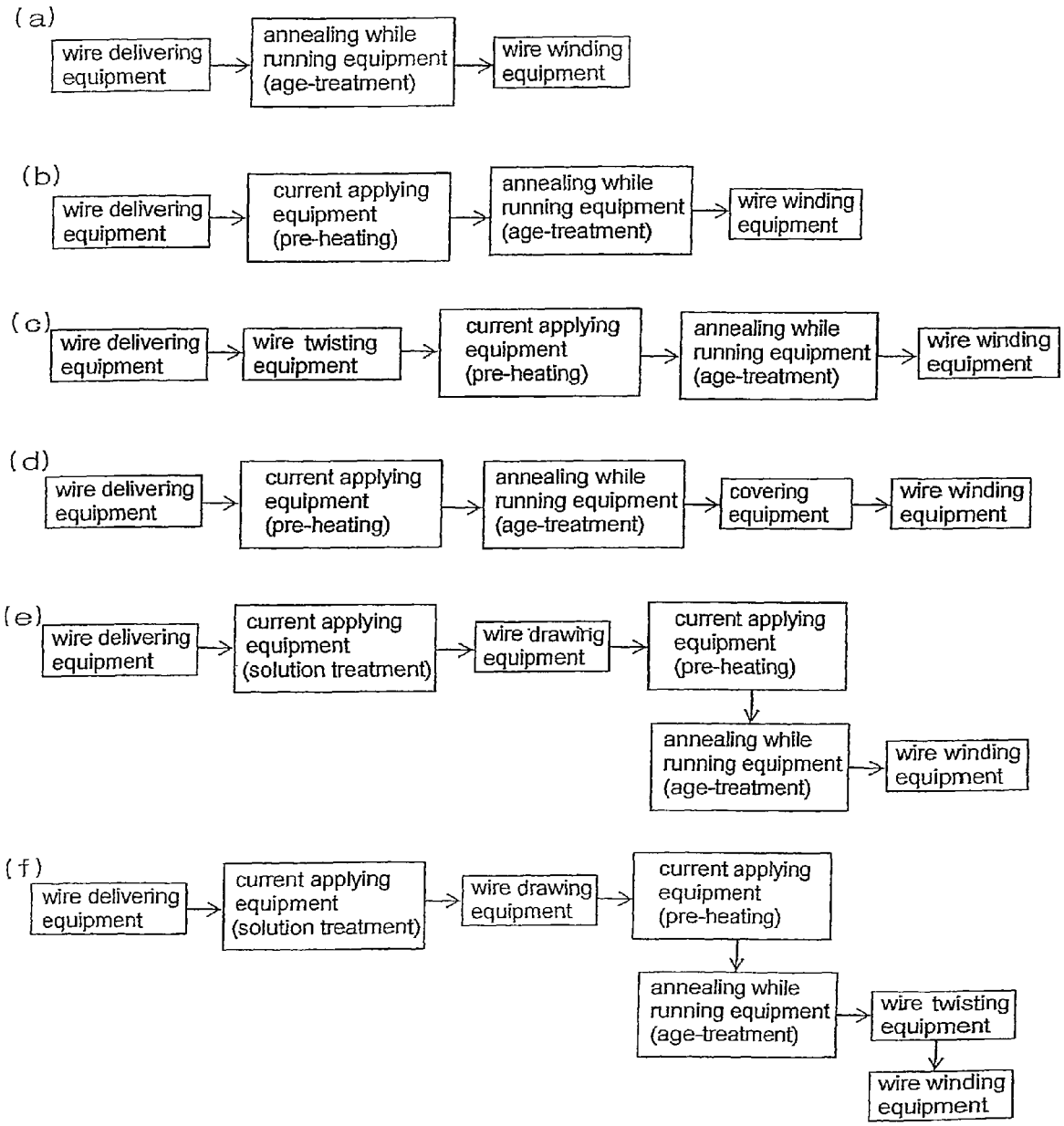
FIG. 4 is a schematic view to explain an apparatus for manufacturing wire of other embodiment of the invention.

FIG. 4 is a schematic view to explain an apparatus for manufacturing wire of other embodiment of the invention. FIG. 4 shows examples of the arrangement of the annealing while running equipment, current applying equipment (pre-heating equipment), wire drawing equipment, wire twisting equipment and the like. When at least one of the wire drawing equipment (wire drawing machine), covering equipment (covering machine), and wire twisting equipment (wire twisting machine) are arranged in tandem, it is possible to put all the plurality of processes together to shorten the time needed in manufacturing.

FIG. 4(*a*) is a view of equipment arrangement to explain the apparatus for manufacturing wire shown with reference to FIG. 1. In the arrangement as shown in FIG. 4(*a*), the wire is heated and the temperature of the wire is maintained in the annealing while running equipment to apply age-treatment. More specifically, the wire having a prescribed diameter (the diameter of from 0.03 mm to 3 mm, preferably from 0.1 mm to 1 mm) is delivered from the wire delivering equipment, is heated to a temperature of from 300 degrees Celsius to 600 degrees Celsius, and is held for a time period of from over 10 seconds to 1200 seconds at the above temperature to apply age-treatment. Then, the wire is wound by the wire winding equipment. In the annealing while running equipment with the temperature of from 300 degrees Celsius to 600 degrees Celsius therein, a plurality pairs of guide rolls are respectively arranged at both of the end portions of the wire inlet end portion and the wire outlet end portion so that the wire entering from the inlet side passes while turning a plurality of times between the guide rolls to go out of the outlet side. The time necessitated for the wire to stay within the furnace while turning a plurality of times between the guide rolls is from over 10 seconds to 1200 seconds.

The reason why the heating temperature in the annealing while running equipment is from 300 degrees Celsius to 600 degrees Celsius is that with the temperature below 300 degrees Celsius, the precipitation of the age-precipitation copper alloy is not sufficient, and with the temperature of over 600 degrees Celsius, the precipitation becomes coarse and re-solution begins to lower the property. The reason why the heating time in the annealing while running equipment is from over 10 seconds to 1200 seconds is that with the heating time up to 10 seconds, the precipitation of the age-precipitation copper alloy is not sufficient, and with the heating time over 1200 seconds, the equipment becomes so long and large, resulting in not practical.

FIG. 4 (*b*) is the equipment arrangement in which the current applying equipment is arranged in tandem at the upstream side of the annealing while running equipment. In this embodiment, separate current applying equipment (pre-heating equipment) for heating from the annealing while running equipment is arranged to quickly heat the wire to a prescribed temperature. More specifically, the wire having a prescribed diameter (the diameter of from 0.03 mm to 3 mm, preferably from 0.1 mm to 1 mm) is delivered from the wire delivering equipment, is heated to a temperature of from 300 degrees Celsius to 600 degrees Celsius for up to 5 seconds in the current applying equipment (pre-heating equipment). Thus heated wire in the current applying equipment (pre-heating equipment) is then introduced into the annealing while running equipment and heated to a temperature from 300 degrees Celsius to 600 degrees Celsius, and is held for a time period of from over 10 seconds to 1200 seconds at the above temperature to apply age-treatment. Then, the wire is wound by the wire winding equipment. As described above, the separate current applying equipment for pre-heating from the annealing while running equipment is arranged to quickly raise the temperature of the wire to a desired temperature. Accordingly, time necessitated for the age-treatment is shortened compared with the embodiment as shown in FIG. 1(*a*) in which the wire is heated and held in the annealing while running equipment.

The reason why the heating temperature in the current applying equipment (pre-heating equipment) is from 300 degrees Celsius to 600 degrees Celsius, and the time for heating is within 5 seconds is that the temperature range of the age-treatment in the following annealing while running equipment is from 300 degrees Celsius to 600 degrees Celsius. More specifically, with the temperature below 300 degrees Celsius, a desired effect may not be obtained, and with the temperature of over 600 degrees Celsius, the precipitation becomes coarse and re-solution begins to lower the property. The reason why the heating time in the current applying equipment (pre-heating equipment) is within 5 seconds is that with the heating time over 5 seconds, the size of the current applying equipment becomes large to necessitate a large space, and with the heating time up to 0.3 seconds, the desired effect may not be obtained.

FIG. 4 (*c*) is the equipment arrangement in which the current applying equipment (pre-heating equipment) is arranged in tandem at the upstream side of the annealing while running equipment, and a wire twisting equipment is further arranged at the upstream side of the current applying equipment (pre-heating equipment). In FIG. 4(*c*), in general, the corresponding number of wire delivering equipments to the single wires to be twisted are arranged at upstream side of the wire twisting equipment, however, only one wire twisting equipment is shown in FIG. 4(*c*) and others are omitted. As shown in FIG. 4(*c*), the wire having a prescribed diameter (the diameter of from 0.03 mm to 3 mm, preferably from 0.1 mm to 1 mm) is delivered from the wire delivering equipment, and twisted in the wire twisting equipment to prepare the twisted wire. Thus prepared twisted wire is heated to a temperature from 300 degrees Celsius to 600 degrees Celsius within 5 seconds in the current applying equipment (pre-heating equipment). Thus heated wire in the current applying equipment (pre-heating equipment) is then introduced into the annealing while running equipment and heated to a temperature from 300 degrees Celsius to 600 degrees Celsius, and is held for a time period of from over 10 seconds to 1200 seconds at the above temperature to apply age-treatment. Then, the wire is wound by the wire winding equipment. Even though the twisted wire is formed and then the age-treatment is applied thereto, wires forming twisted wire are not adhered each other, not like the wires in the batch-type annealing furnace. The reason therefore is considered as that any force to adhere the wires is not applied thereto. The wire twisting equipment may be arranged immediately after the annealing while running equipment in stead of arranged immediately before the current applying equipment (pre-heating equipment).

FIG. 4 (*d*) is the equipment arrangement in which the current applying equipment (pre-heating equipment) is arranged in tandem at the upstream side of the annealing while running equipment, and a covering equipment is further arranged at the downstream side of the annealing while running equipment. In this embodiment, the wire is pre-heated, age-treated, covered and then wound by the wire winding equipment. The wire having a prescribed diameter (the diameter of from 0.03 mm to 3 mm, preferably from 0.1 mm to 1 mm) is delivered from the wire delivering equipment, and heated to a temperature from 300 degrees Celsius to 600 degrees Celsius within 5 seconds in the current applying equipment (pre-heating equipment). Thus heated wire in the current applying equipment (pre-heating equipment) is then introduced into the annealing while running equipment and heated to a temperature from 300 degrees Celsius to 600 degrees Celsius, and is held for a time period of from over 10 seconds to 1200 seconds at the above temperature to apply age-treatment. Then, the wire is wound by the wire winding equipment. The wire twisting equipment may be arranged immediately before the current applying equipment (pre-heating equipment) or immediately after annealing while running equipment (immediately before the covering equipment) so that covered twisted wire may be prepared.

FIG. 4(*e*) is a view to explain the apparatus for manufacturing wire of the invention in which solution treatment and age-treatment are continuously carried out. As shown in FIG. 4(*e*), the apparatus for manufacturing wire includes in tandem the wire delivering equipment, the current applying equipment for solution treatment (solution treating equipment), the current applying equipment for heating (pre-heating equipment), the annealing while running equipment, and the wire winding equipment. In this embodiment, not only the equipment for age-treatment, but also the equipment for solution treatment are arranged in tandem, and those treatments are continuously carried out.

As shown in FIG. 4(*e*), the wire having a larger diameter than the prescribed diameter (i.e., the diameter of from 0.03 mm to 3 mm, preferably from 0.1 mm to 1 mm), (for example, the wire of which diameter is a few mm, so-called wire rod) is delivered from the wire delivering equipment, is heated to a temperature of at least 800 degrees Celsius for up to 5 seconds, and immediately thereafter is rapidly cooled by water cooling or the like to be subjected to solution treatment. Thus solution-treated wire is drawn by the wire drawing equipment to prepare the wire having a prescribed diameter (the diameter of from 0.03 mm to 3 mm, preferably from 0.1 mm to 1 mm). Thus drawn wire is heated to a temperature from 300 degrees Celsius to 600 degrees Celsius for up to 5 seconds in the current applying equipment (pre-heating equipment). Thus heated wire in the current applying equipment (pre-heating equipment) is then introduced into the annealing while running equipment and heated to a temperature from 300 degrees Celsius to 600 degrees Celsius, and is held for a time period of from over 10 seconds to 1200 seconds at the above temperature to apply age-treatment. Then, thus age-treated wire is wound by the wire winding equipment.

FIG. 4(*f*) is a view to explain other embodiment of the apparatus for manufacturing wire of the invention in which solution treatment and age-treatment are continuously carried out. In this embodiment, as shown in FIG. 4(*f*), the wire having a larger diameter than the prescribed diameter (i.e., the diameter of from 0.03 mm to 3 mm, preferably from 0.1 mm to 1 mm), (for example, the wire of which diameter is a few mm, so-called wire rod) is delivered from the wire delivering equipment, is heated to a temperature of at least 800 degrees Celsius for up to 5 seconds, and immediately thereafter is rapidly cooled by water cooling or the like to be subjected to solution treatment. Thus solution-treated wire is drawn by the wire drawing equipment to prepare the wire having a prescribed diameter (the diameter of from 0.03 mm to 3 mm, preferably from 0.1 mm to 1 mm). Then, thus drawn wire is heated to a temperature from 300 degrees Celsius to 600 degrees Celsius for up to 5 seconds in the current applying equipment (pre-heating equipment). Thus heated wire in the current applying equipment (pre-heating equipment) is then introduced into the annealing while running equipment and heated to a temperature from 300 degrees Celsius to 600 degrees Celsius, and is held for a time period of from over 10 seconds to 1200 seconds at the above temperature to apply age-treatment. Thus age-treated wire is twisted by the wire twisting equipment to prepare the twisted wire, and wound by the wire winding equipment. In FIG. 4(*f*), the corresponding number of equipments (i.e., the wire delivering equipment, the solution treating equipment, the wire drawing equipment, the pre-heating equipment, the annealing while running equipment) to the single wires to be twisted are arranged in tandem at upstream side of the wire twisting equipment, however, only one wire twisting equipment is shown in FIG. 4(*f*) and others are omitted. The wire twisting equipment may be arranged immediately before the current applying equipment, in stead of arranged immediately after the annealing while running equipment, as the same manner as shown in FIG. 4(*c*).

The reason why the heating temperature in the current applying equipment (solution treating equipment) is at least 800 degrees Celsius is that with the temperature up to 800 degrees Celsius, the solution treatment is not satisfactory so as to cause the precipitation produced in the following age-treatment to be poor. Although it is desirable that the heating temperature is as high as possible, the temperature up to 950 degrees Celsius is preferable in view of the cost necessary for the equipment. The reason why the time for heating is up to 5 seconds is that with the time of over 5 seconds, the crystal grain thereof becomes coarse to lower proof stress or flexibility. With the time of up to 0.1 second, expected effect is not obtained.

According to the apparatus for manufacturing wire of the invention, as described above, various equipment such as the current applying equipment for solution treatment (solution treating equipment), the wire drawing equipment, the current applying equipment for heating (pre-heating equipment), and annealing while running equipment are arranged in tandem to enable to continuously manufacture the wire having a desired diameter and property.

The method for manufacturing wire of the invention is described.

One of the embodiment of the method for manufacturing wire of the invention is the method for manufacturing wire comprising the steps of: delivering an age-precipitation copper alloy wire; causing the delivered wire to turn around a plurality of times along a running route of the heating while being maintained for a prescribed time period and within a prescribed temperature range to be subjected to age-treatment; and winding the wire with the aging treatment thus applied. The prescribed temperature range is the temperature between the lower limit of age-treatment and the upper limit of age-treatment, specifically, from 300 degrees Celsius to 600 degrees Celsius and the prescribed time is from over 10 seconds to 1200 seconds.

The method may includes the step of applying current to the wire (i.e., pre-heating) prior to age-treatment. The wire is heated at the temperature from 300 degrees Celsius to 600 degrees Celsius for up to 5 seconds. Although this step mainly intends to pre-heat the wire, the age-treatment is substantially started at the time when the temperature of the wire becomes at least the lower limit of the aging temperature. The method may includes the step of applying solution treatment to the wire prior to age-treatment (prior to pre-heating in case of that the wire is pre-heated). The wire is heated at the temperature of at least 800 degrees Celsius for a time period of up to 5 seconds, and immediately after that, rapidly cooling by water cooling to be subjected to solution treatment.

As described above, according to the method for manufacturing wire of the invention, the age-treatment is carried out through continuous annealing. Since the annealing while running equipment may be arranged in tandem with various continuing equipments (for example, the wire twisting equipment, covering equipment, the wire drawing equipment), it is possible to shorten the processes. The continuous manufacturing through the solution-aging process may be possible when the current applying equipment exclusively for solution (i.e., solution treating equipment) is arranged at upstream side of the annealing while running equipment. Furthermore, the continuous manufacturing through the solution-drawing-aging process, the solution-aging-drawing process, or the solution-drawing-aging-drawing process may be possible when the wire drawing machine is arranged before or after the annealing while running equipment, thus wires having various properties can be obtained.

Other embodiment of the apparatus for manufacturing wire and method thereof are described in detail with reference to the drawings.

One embodiment of the apparatus for manufacturing wire is an apparatus for manufacturing wire comprising: a wire delivering equipment; a wire winding equipment; and an annealing while running equipment installed between the wire delivering equipment and the wire winding equipment, wherein age-precipitation copper alloy wire is passed through the annealing while running equipment while a temperature of the wire is maintained between an upper limit of aging temperature and a lower limit of aging temperature. The annealing while running equipment comprises a plurality of current applying equipments to raise a temperature of the wire by generated Joule heat, and the wire is passed through the plurality of current applying equipments in sequence while the temperature of the wire is maintained at a temperature between an upper limit of aging temperature and a lower limit of aging temperature.

The plurality of current applying equipments arranged in tandem comprises at least one temperature raise current applying equipment and at least one temperature maintaining current applying equipment, and the temperature of the wire is raised to a prescribed temperature by the current applying equipment for heating, while the temperature of the wire is maintained between an upper limit of the aging temperature and a lower limit of the aging temperature by the current applying equipment for maintaining temperature. More specifically, in the apparatus of the invention, the wire is heated in the current applying equipment for heating and the current applying equipment for maintaining temperature which are arranged in tandem with space so that the temperature of the wire is maintained at the temperature between the upper limit of aging temperature and the lower limit of aging temperature even if the temperature of the wire lowers when passing the equipments.

In the heating by the applied current, the wire itself is heated by the Joule heat generated by the current flowing in the wire. The raised temperature ΔT of the material, when heat loss is neglected, is given by the following equation:

$$\Delta T = P \cdot t / m(m \cdot C) \quad (1)$$

where, P is the applied power, t is a time period for applying the power, m is mass of the material, and C is specific heat.

Since the wire is not fixed but delivered at a certain speed in the current applying equipment, the time period for applying the power changes every second, and the temperature of the material gradually rises.

The expected heat treatment in the invention is aging heat treatment. When the temperature of the material is too low to reach a prescribed temperature (i.e., the temperature between the lower limit of aging temperature an d the upper limit of aging temperature, practically the temperature of from 300 degrees Celsius to 600 degrees Celsius), the precipitation is not produced. On the other hand, when the temperature of the material is too high to be over the prescribed temperature, the precipitation becomes coarse not to contribute to improve a desired property. It is necessary to heat the material at the temperature (i.e., the temperature between the lower limit of aging temperature an d the upper limit of aging temperature, practically the temperature of from 300 degrees Celsius to 600 degrees Celsius) for a certain time period (i.e., over 10 seconds to 1200 seconds).

To realize the above, in the present invention, a plurality of current applying equipments are arranged in tandem with spacing to be configured to form one annealing wile running equipment as a whole. More specifically, the temperature of the wire passing through one current applying equipment rises, however, the wire is configured to go out of the current applying equipment before the temperature of the wire rises beyond the aging temperature range. Then, the wire is planed to enter the next current applying equipment before the temperature of the wire lowers below the aging temperature range. The wire can be heated for a prescribed time period through the above-described repeated operation.

The current applying equipment needs a rather large power to cause the temperature of the wire to initially reach the prescribed temperature. The power to be applied in the following current applying equipment for maintaining the temperature is determined based on the aging temperature range. The spacing between the current applying equipments is also determined based on the aging temperature range.

Figure 5:
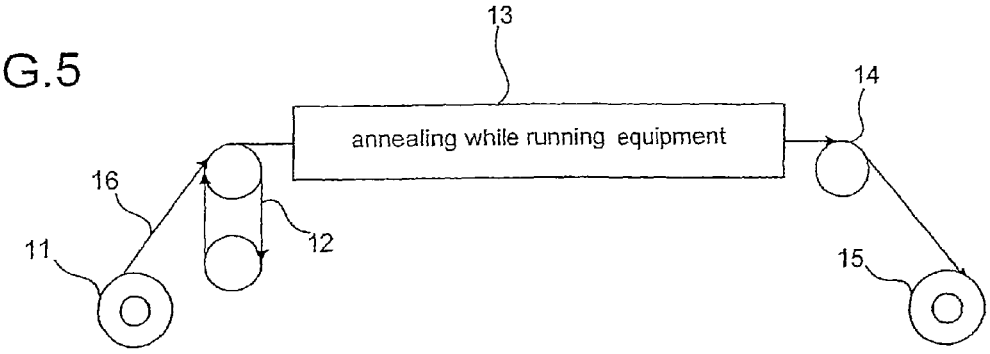
FIG. 5 is a schematic view to explain one example of the annealing while running equipment (i.e., current applying equipment, herein after referred to as annealing while running equipment) of the invention.

FIG. 5 is a schematic view to explain one example of the annealing while running equipment (i.e., current applying equipment, herein after referred to as annealing while running equipment) of the invention. As shown in FIG. 5, the apparatus for manufacturing the wire of the invention includes the wire delivering equipment 11, the wire winding equipment 15, the annealing while running equipment arranged between the wire delivering equipment 11 and the wire winding equipment 15. The annealing while running equipment 13 comprises a plurality of current applying equipments arranged in tandem with a prescribed spacing through which the age-precipitation copper ally wire 16 sequentially passes with the temperature of the wire maintained between the upper limit of aging temperature and the lower limit of aging temperature.

In the apparatus for manufacturing the wire shown in FIG. 5, in order to secure a required heating time period (i.e., time period necessary for age treatment), a plurality of current applying equipments are arranged in tandem with the prescribed spacing within the annealing while running equipment. As a result, the wire stays within the annealing while running equipment 13 for a longer than the conventional apparatus to secure the prescribed necessary age-treating time period.

As shown in FIG. 5, the tensile force of the wire 16 delivered by the wire delivering equipment 11 is stabled by so-called dancer-equipment 12. Then, the wire passes through the annealing while running equipment 13 to be heated to a prescribed temperature, and then is maintained at the temperature between the upper limit of aging temperature and the lower limit of ageing temperature, thus is subjected to age treatment. The wire is wound through a pulling capstan 14 by the wire winding equipment 15.

Figure 6:
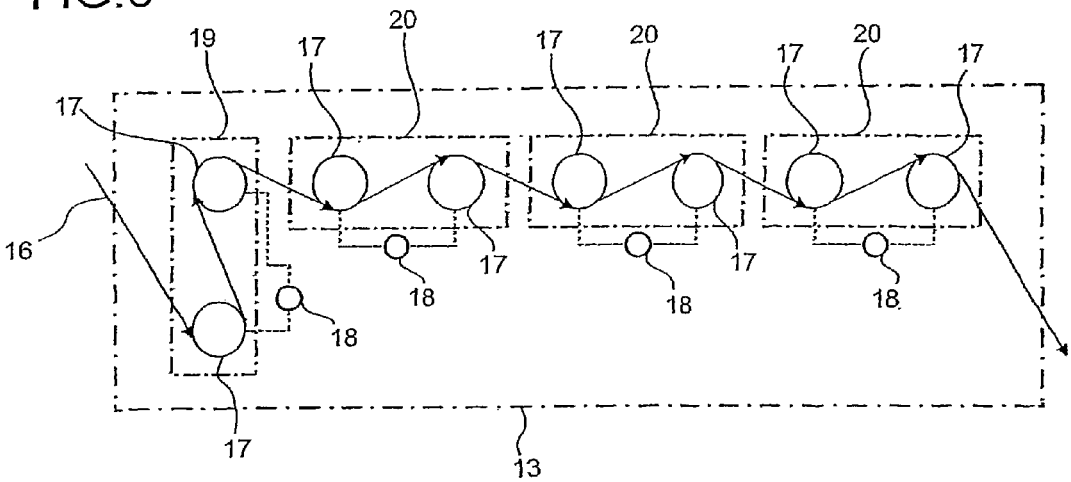
FIG. 6 is a schematic view to show the inner structure of the annealing while running equipment 13 as shown in FIG. 5.

FIG. 6 is a schematic view to show the inner structure of the annealing while running equipment 13 as shown in FIG. 5. Within the annealing while running equipment 13, at least 2 current applying equipments 119, 20 are arranged with spacing. The wire 16 introduced into the current applying equipment 13 from the wire delivering side is heated to a prescribed temperature in the current applying equipment for rising temperature i.e., heating, then the temperature of the wire is maintained in the current applying equipment for maintaining temperature, and then the wire goes out of the annealing while running equipment 13. Since the plurality of current applying equipments 19, 20 are arranged with a prescribed spacing, the longer time period for the wire to be stationed within the annealing while running equipment 13 is secured, the sufficient precipitation to improve the strength is realized by age treatment.

Although FIG. 6 shows as preferable example, one current applying equipment for rising temperature and three current applying equipments for maintaining temperature, at least one equipment respectively will be all right. The current applying equipment 19, 20 applies current through a pair of guide rolls 17 for example to the wire 16, to raise the temperature of the wire 16.

The heating of the wire by current applying means that the current is directly applied to the wire through metal contacts such as roller, pulley or the like, or the current is indirectly generated by the induction coil and applied to the wire so that the Joule heat generated by the electric resistance of the wire rises the temperature and heat the wire itself.

The current applying equipment 19 needs a rather large power to cause the temperature of the wire to initially reach the prescribed temperature (i.e., the temperature between the lower limit of aging temperature an d the upper limit of aging temperature, practically the temperature of from 300 degrees Celsius to 600 degrees Celsius). The power to be applied in the following current applying equipment 20 for maintaining the temperature is determined based on the aging temperature range of the wire. The spacing between the current applying equipments 20 is also determined based on the aging temperature range.

Figure 7:
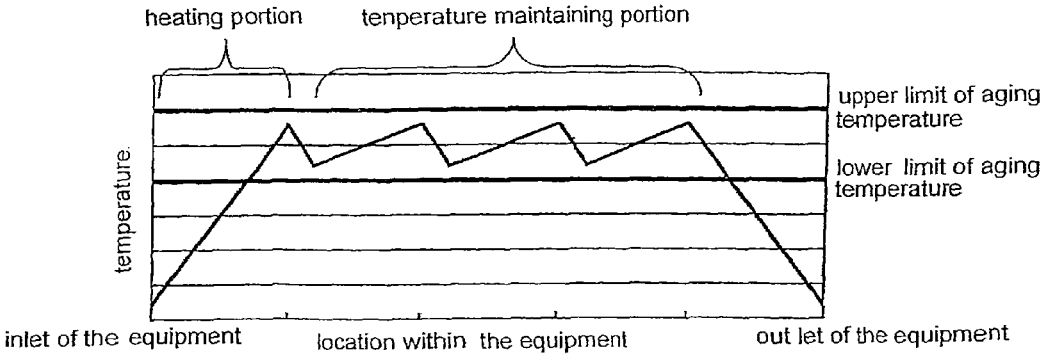
FIG. 7 shows variation of the temperature within the annealing while running equipment 13.

FIG. 7 shows variation of the temperature within the annealing while running equipment 13. When the wire 16 enters into the annealing while running equipment 13, the temperature of the wire rapidly rises over the lower limit of age temperature by the current applying equipment 19 for rising temperature. Then, the temperature repeats rising and falling when the wire passes through a plurality of current applying equipments 20 for maintaining temperature arranged in tandem with a prescribed spacing to be maintained within a desired temperature range (i.e., between the upper limit of aging temperature and the lower limit of aging temperature) for a certain time period.

More specifically, since the temperature of the wire 16 rises over the lower limit of aging temperature in the current applying equipment 19 for rising temperature, and the wire is not heated from the time when the wire goes out of the current applying equipment 19 for rising temperature until the wire enters into the next the current applying equipment 20 for maintaining temperature, the temperature of the wire lowers. The heating temperature in the current applying equipment 19 for rising temperature is determined such that the temperature of the wire does not lower the lower limit of aging temperature, and in addition, the spacing between the current applying equipment 19 for rising temperature and the current applying equipment 20 for maintaining temperature is determined as well as the heating temperature.

Then, the wire 16 passes through the plurality of the current applying equipments 20 for maintaining temperature. The heating temperature in the current applying equipment 20 for maintaining temperature, and the spacing between the current applying equipments 20 for maintaining temperature is determined such that the temperature of the wire 16 is maintained between the lower limit of aging temperature and the upper limit of aging temperature. Accordingly, the temperature of the wire 16 repeats rising and falling between the lower limit of aging temperature and the upper limit of aging temperature.

Further, a solution treatment may be applied prior to the age-treatment. In order to apply solution treatment, solution treating equipment comprising the current applying equipment for example is used. By this arrangement, the solution treatment and the age-treatment may be continuously carried out. Wire drawing machine is further arranged to enable to manufacture the wire having a desired diameter and property by continuous treatment.

Figure 8:
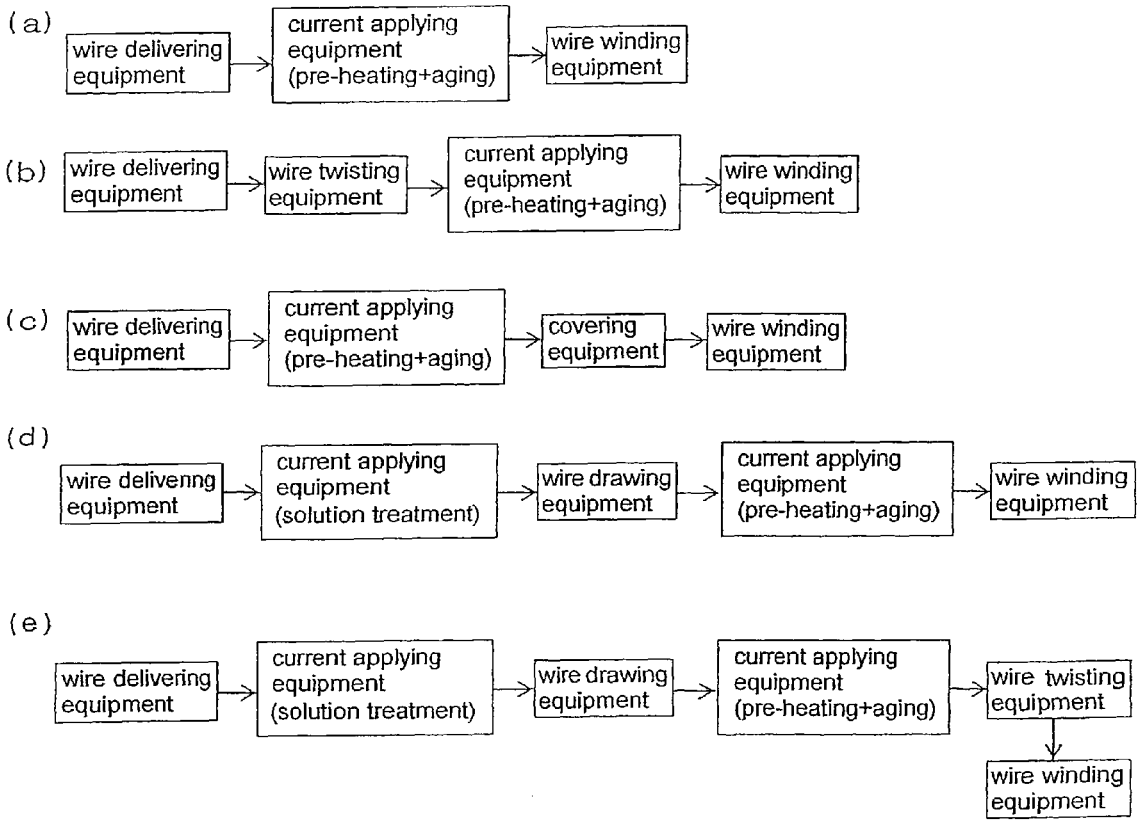
FIGS. 8*a*-8*e* are flowcharts describing different methodologies corresponding to embodiments of the apparatus for manufacturing wire of the invention.

FIG. 8 is a schematic view to explain various embodiments of the apparatus for manufacturing wire of the invention. FIG. 8 shows examples of the arrangement of the annealing while running equipment, current applying equipment (solution treating equipment), wire drawing equipment, wire twisting equipment and the like. When at least one of the wire drawing equipment (wire drawing machine), covering equipment (covering machine), and wire twisting equipment (wire twisting machine) are arranged in tandem, it is possible to put all the plurality of processes together to shorten the time needed in manufacturing.

FIG. 8(*a*) is the equipment arrangement to explain the apparatus for manufacturing wire of the invention described with reference to FIG. 5. In the arrangement shown in FIG. 8(*a*), the wire is heated in the current applying equipment (pre-heating+aging) for rising temperature and the temperature is held in the current applying equipment for maintaining temperature to apply age treatment. The temperature of the wire is lowered between the equipments, thus the temperature of the wire is maintained within the aging temperature range. More specifically, the wire having a prescribed diameter (the diameter of from 0.03 mm to 3 mm, preferably from 0.1 mm to 1 mm) is delivered from the wire delivering equipment, is heated to a temperature from 300 degrees Celsius to 600 degrees Celsius, and is held for a time period of from over 10 seconds to 1200 seconds at the above temperature (i.e., repeated operation of the temperature being raised and lowered) to apply age-treatment. Then, the wire is wound by the wire winding equipment.

In the current applying equipment for rising temperature, the wire is heated to a prescribed temperature between the upper limit of aging temperature and the lower limit of aging temperature, and the temperature of the wire is lowered to at least the lower limit of aging temperature without applying current until the wire is introduced into the next current applying equipment for maintaining temperature. Then the wire is heated to up to the upper limit of aging temperature in the current applying equipment for maintaining temperature. Thus the wire is heated and then the temperature of the wire is lowered. This process is repeated such that the temperature of the wire is maintained between the upper limit of aging temperature and the lower limit of aging temperature to apply age treatment. The guide roll is arranged in the respective current applying equipment and current is applied to the wire.

The time period for the wire staying within the annealing while running equipment is from over 10 seconds to 1200 seconds, where the wire is heated in the current applying equipment and the temperature of the wire is lowered between the equipment.

The reason why the temperature in the annealing while running equipment is from 300 degrees Celsius to 600 degrees Celsius is that with the temperature below 300 degrees Celsius, the precipitation of the age-precipitation copper alloy is not sufficient, and with the temperature of over 600 degrees Celsius, the precipitation becomes coarse and re-solution begins to lower the property. The reason why the heating time in the annealing while running equipment is from over 10 seconds to 1200 seconds is that with the heating time up to 10 seconds, the precipitation of the age-precipitation copper alloy is not sufficient, and with the heating time over 1200 seconds, the equipment becomes so long and large, resulting in not practical.

FIG. 8 (*b*) is the equipment arrangement in which the wire twisting equipment is arranged in tandem at the upstream side of the current applying equipment (pre-heating+aging). In FIG. 8(*b*), in general, the corresponding number of wire delivering equipments to the single wires to be twisted are arranged at upstream side of the wire twisting equipment, however, only one equipment is shown in FIG. 8(*b*) and others are omitted. As shown in FIG. 8(*b*), the wire having a prescribed diameter (the diameter of from 0.03 mm to 3 mm, preferably from 0.1 mm to 1 mm) is delivered from the wire delivering equipment, and twisted in the wire twisting equipment to prepare the twisted wire. Thus prepared twisted wire is heated in the current applying equipment for rising temperature and the current applying equipment for maintaining temperature arranged in the annealing while running equipment, and the temperature of the wire is lowered between the equipments as explained with reference to FIG. 8(*a*), thus the temperature of the wire is maintained within aging temperature range to apply age treatment. More specifically, the wire having a prescribed diameter (the diameter of from 0.03 mm to 3 mm, preferably from 0.1 mm to 1 mm) is delivered from the wire delivering equipment, the wire is heated to a temperature from 300 degrees Celsius to 600 degrees Celsius, and is held for a time period of from over 10 seconds to 1200 seconds at the above temperature to apply age-treatment (the process of heating the wire and the temperature of the wire lowering is repeated). Then, the wire is wound by the wire winding equipment. Even though the twisted wire is formed and then the age-treatment is applied thereto, wires forming twisted wire are not adhered each other, not like the wires in the batch-type annealing furnace. The reason therefore is considered as that any force to adhere the wires is not applied thereto. The wire twisting equipment may be arranged immediately after the current applying equipment in stead of arranged immediately before the current applying equipment.

FIG. 8(*c*) is the equipment arrangement in which the covering equipment is arranged in tandem at the downstream side of the current applying equipment (pre-heating+aging). In this embodiment, the wire is heated, then is subjected to age treatment, then covered and wound by the wire winding equipment. More specifically, the wire having a prescribed diameter (the diameter of from 0.03 mm to 3 mm, preferably from 0.1 mm to 1 mm) is delivered from the wire delivering equipment, and the wire is heated in the current applying equipment for rising temperature and the current applying equipment for maintaining temperature (arranged in the annealing while running equipment), and the temperature of the wire is lowered between the equipments, thus the temperature of the wire is maintained within aging temperature range to apply age treatment. More specifically, the wire having a prescribed diameter (the diameter of from 0.03 mm to 3 mm, preferably from 0.1 mm to 1 mm) is delivered from the wire delivering equipment, the wire is heated to a temperature from 300 degrees Celsius to 600 degrees Celsius, and is held for a time period of from over 10 seconds to 1200 seconds at the above temperature to apply age-treatment (the process of heating the wire and the temperature of the wire lowering is repeated). Thus age-treated wire is covered.

FIG. 8(*d*) is a view to explain the apparatus for manufacturing wire of the invention in which solution treatment and age-treatment are continuously carried out. As shown in FIG. 8(*d*), the apparatus for manufacturing wire includes in tandem the wire delivering equipment, the current applying equipment for solution treatment (solution treating equipment), the wire drawing equipment, the current applying equipment (pre-heating+aging). In this embodiment, not only the equipment for age-treatment, but also the equipment for solution treatment are arranged in tandem, and those treatments are continuously carried out.

As shown in FIG. 8(*d*), the wire having a larger diameter than the prescribed diameter (i.e., the diameter of from 0.03 mm to 3 mm, preferably from 0.1 mm to 1 mm), (for example, the wire of which diameter is a few mm, so-called wire rod) is delivered from the wire delivering equipment, is heated to a temperature of at least 800 degrees Celsius for up to 5 seconds, and immediately thereafter is rapidly cooled by water cooling or the like to be subjected to solution treatment. Thus solution-treated wire is drawn by the wire drawing equipment to prepare the wire having a prescribed diameter (the diameter of from 0.03 mm to 3 mm, preferably from 0.1 mm to 1 mm). Then, thus drawn wire is heated in the current applying equipment for rising temperature and the current applying equipment for maintaining temperature (arranged in the annealing while running equipment), and the temperature of the wire is lowered between the equipments, thus the temperature of the wire is maintained within aging temperature range to apply age treatment. More specifically, the wire having a prescribed diameter (the diameter of from 0.03 mm to 3 mm, preferably from 0.1 mm to 1 mm) is delivered from the wire delivering equipment, the wire is heated to a temperature from 300 degrees Celsius to 600 degrees Celsius, and is held for a time period of from over 10 seconds to 1200 seconds at the above temperature to apply age-treatment (the process of heating the wire and the temperature of the wire lowering is repeated). Then, thus age-treated wire is wound by the wire winding equipment.

The reason why the heating temperature is at least 800 degrees Celsius is that with the temperature up to 800 degrees Celsius, the solution treatment is not satisfactory so as to cause the precipitation produced in the following age-treatment to be poor. Although it is desirable that the heating temperature is as high as possible, the temperature up to 950 degrees Celsius is preferable in view of the cost necessary for the equipment. The reason why the time for heating is up to 5 seconds is that with the time of over 5 seconds, the crystal grain thereof becomes coarse to lower proof stress or flexibility. With the time of up to 0.1 second, expected effect is not obtained.

FIG. 8(*e*) is a view to explain other embodiment of the apparatus for manufacturing wire of the invention in which solution treatment and age-treatment are continuously carried out. As shown in FIG. 8(*e*), the wire having a larger diameter than the prescribed diameter (i.e., the diameter of from 0.03 mm to 3 mm, preferably from 0.1 mm to 1 mm), (for example, the wire of which diameter is a few mm, so-called wire rod) is delivered from the wire delivering equipment, is heated to a temperature of at least 800 degrees Celsius for up to 5 seconds in the current applying equipment (solution treating equipment), and immediately thereafter is rapidly cooled by water cooling or the like to be subjected to solution treatment. Thus solution-treated wire is drawn by the wire drawing equipment to prepare the wire having a prescribed diameter (the diameter of from 0.03 mm to 3 mm, preferably from 0.1 mm to 1 mm). Then, thus drawn wire is heated in the current applying equipment for rising temperature and the current applying equipment for maintaining temperature, and the temperature of the wire is lowered between the equipments, thus the temperature of the wire is maintained within the aging temperature range to apply age treatment. More specifically, the wire having a prescribed diameter is delivered from the wire delivering equipment, the wire is heated to a temperature from 300 degrees Celsius to 600 degrees Celsius, and is held for a time period of from over 10 seconds to 1200 seconds at the above temperature to apply age-treatment (the process of heating the wire and the lowering the temperature of the wire is repeated). Then, thus age-treated wires are twisted by the wire twisting equipment to prepare twisted wire, and the twisted wire is wound by the wire winding equipment. In FIG. 8(*e*), the corresponding number of equipments (i.e., the wire delivering equipment, the solution treating equipment, the wire drawing equipment, the current applying equipment (pre-heating+aging) to the single wires to be twisted are arranged in tandem at upstream side of the wire twisting equipment, however, only one wire twisting equipment is shown in FIG. 8(*e*) and others are omitted. The wire twisting equipment may be arranged immediately before the current applying equipment, in stead of arranged immediately after the annealing while running equipment, as the same manner as shown in FIG. 8(*b*).

According to the apparatus for manufacturing wire of the invention, as described above, various equipment such as the current applying equipment for solution treatment (solution treating equipment), the wire drawing equipment, the current applying equipment or the like are arranged in tandem to enable to continuously manufacture the wire having a desired diameter and property.

The method for manufacturing wire of the invention is described hereunder.

One embodiment of the method for manufacturing wire comprises the steps of: delivering an age-precipitation copper alloy wire; heating the delivered wire while running to be subjected to aging treatment; and winding the wire with the aging treatment thus applied. In the aging treatment, the delivered wire is passed through respective at least one different current applying regions, and no current applying region between said current applying regions in which a temperature of the wire is lowered, while the wire is maintained within a prescribed temperature range.

The different current applying region comprises a temperature raised current applying region in which the temperature of the wire is raised to a prescribed temperature and a temperature maintained current applying region in which the temperature of the wire is maintained within a prescribed temperature range, and the temperature of the wire is maintained between an upper limit of aging temperature and a lower limit of aging temperature. More specifically, the age-precipitation copper alloy wire is held as heated at the temperature within 300 degrees Celsius to 600 degrees Celsius and for a time period of over 10 seconds to 1200 seconds. Preferably, the solution treatment is applied to the wire prior to age treatment. The wire is heated at a temperature of at least 800 degrees Celsius and for a time period of up to 5 seconds, and immediately thereafter, rapidly cooled by the water cooling or the like to apply solution treatment.

The reason why the heating temperature in the solution treatment is at least 800 degrees Celsius is that with the temperature below 800 degrees Celsius, the solution treatment is not satisfactory so as to cause the precipitation produced in the following age-treatment to be poor. Although it is desirable that the heating temperature is as high as possible, the temperature up to 950 degrees Celsius is preferable in view of the cost necessary for the equipment. The reason why the time for heating in the solution treatment is up to 5 seconds is that with the time of over 5 seconds, the crystal grain thereof becomes coarse to lower proof stress or flexibility. With the time of up to 0.1 second, expected effect is not obtained.

Embodiments of the copper alloy wire of the invention are described hereunder. The copper alloy wire in the present invention means practical copper alloy wire used for a wiring material applied to an automobile and robot, a lead wire applied to electronic devices, a connector pin, coil spring or the like among the wires as the formed metal material. The copper alloy wire of the invention is the age-precipitation copper alloy wire manufactured by the method and apparatus for manufacturing wire as described above. For example, Colson alloy (Cu—Ni—Si), Cu—Cr, Cu—Ti, Cu—Fe, Cu—Ni—Ti or the like is listed. The copper alloy wire has a diameter of from 0.03 mm to 3 mm, preferably from 0.1 mm to 1 mm. With the diameter below 0.03 mm, possibility of the wire being broken down becomes rapidly higher, and with the diameter over 3 mm, amount of heat applied to the wire per unit length is increased, resulting in not being effectively age treated by the continuous annealing.

Various embodiments are explained hereunder.

(Cu—Ni—Si)

Cu—Ni—Si copper alloy used in the copper alloy wire of the invention consists essentially of Ni from 1.5 to 4.0 mass %, Si from 0.3 to 1.1 mass %, balance being Cu and inevitable impurities, or the copper alloy consists essentially of Ni from 1.5 to 4.0 mass %, Si from 0.3 to 1.1 mass %, at least one element selected from the group consisting of Ag, Mg, Mn, Zn, Sn, P, Fe, Cr, and Co from 0.01 to 1.0 mass %, balance being Cu and inevitable impurities.

It is known that when Ni and Si are added to Cu, Ni—Si compound ($Ni_2Si$ phase) is precipitated in the matrix of the Cu to improve the strength and electrical conductivity. With the Ni content below 1.5 mass %, the amount of the precipitation is too less to obtain the necessary strength. With the Ni content over 4.0 mass %, on the other hand, the precipitation is occurred which is not contributed to increase the strength at the time of casting or heat treatment (for example, solution treatment, age-treatment, annealing), thus not obtaining the strength matched to the added content, in addition, affecting wire drawing workability, bending workability.

Since the precipitated Ni—Si compound is considered to be $Ni_2Si$ phase, the optimum Si content to be added is decided based on the decided Ni content to be added. With the Si content below 0.3 mass %, the sufficient strength is not obtained as same as the insufficient low content of Ni. With the Si content over 1.1 mass %, on the other hand, the same problem as the excess Ni content occurs.

The respective content of Ag, Mg, Mn, Zn, Sn, P, Fe, Cr, and Co when to be added is explained hereunder. Ag, Mg, Mn, Zn, Sn, P, Fe, Cr, or Co has effect to improve the strength, workability, Sn plating heat resistance peeling property or the like. When to be added, total content of at least one element selected from the group consisting of Ag, Mg, Mn, Zn, Sn, P, Fe, Cr, and Co is from 0.01 to 1.0 mass %. The respective element to be added is described in detail hereunder.

Ag improves strength and heat resistance, and at the same time prevents the crystal grain size from coarsening to improve bending workability. With the Ag content below 0.01 mass %, the above effect is not sufficiently obtained. With the Ag content over 0.3 mass %, although bad effect does not appear, the cost becomes expensive. Thus, the content of Ag is from 0.01 to 0.3 mass %.

Mg improves stress resistance mitigation feature, but affects bending workability. From the stress resistance mitigation feature, the content of Mg is preferably more than 0.01 mass %. On the other hand, from the bending workability, it is difficult to obtain excellent bending workability with the Mg content over 0.2 mass %. Thus, the content of Mg is from 0.01 to 0.2 mass %.

Mn has effect to increase the strength, and at the same time to improve hot workability. With the Mn content below 0.01 mass %, the above effect is small, and with the Mn content over 0.5 mass %, the matched effect to be added is not obtained, and the electrical conductivity is deteriorated. Thus, the content of Mn is from 0.01 to 0.5 mass %.

Zn improves heat resistance peeling property of Sn plating or soldering, and migration resistance. It is preferable to add at least 0.2 mass %. Considering the electrical conductivity, it is not favorable to add over 1.0 mass %.

Sn improves strength and stress resistance mitigation feature, as well as wire drawing workability. With the Sn content below 0.1 mass %, the effect of improving does not appear, on the other hand, with Sn content over 1.0 mass %, the electrical conductivity is lowered.

P has effect to increase the strength, and at the same time to improves the electrical conductivity. Excess content of P promotes the precipitation in the grain boundary to lower the bending workability. Thus, favorable content of P is from 0.01 to 0.1 mass %.

Either Fe or Cr is bound to form Fe—Si compound, or Cr—Si compound to increase the strength. Furthermore, neither Fe nor Cr forms Fe—Ni compound or Si—Cr compound, and Fe or Cr traps the Si remaining in the Cu matrix to improve the electrical conductivity. Both of the Fe—Si compound and the Cr—Si compound have a low precipitation hardening ability, thus the producing of large amount of the compound is not favorable. With the content of Fe or Cr over 0.2 mass %, the bending workability is deteriorated. Thus, the Fe and Cr contents are from 0.01 to 0.2 mass %, respectively.

Co forms compound with Si in the same manner as Ni to increase the strength. Since Co is expensive compared with Ni, Cu—Ni—Si alloy is used in the invention, however, Cu—Co—Si alloy or Cu—Ni—Co—Si may be selected when the cost of using Co is available. When age-precipitated, the Cu—Co—Si alloy has slightly better strength and electrical conductivity than the Cu—Ni—Si alloy. The Cu—Co—Si alloy is effective to the material in which the thermal and electrical conductivity is important. Since Co—Si compound has a slightly higher precipitation hardening ability, the stress resistance mitigation feature has tendency to be slightly improved. Thus, the Co content to be added is from 0.05 to 1 mass %.

(Cu—Cr)

Cu—Cr alloy used in the copper alloy wire of the invention consists essentially of Cr from 0.1 to 1.5 mass %, balance being Cu and inevitable impurities, or the alloy consists essentially of Cr from 0.1 to 1.5 mass %, at least one elements selected from the group consisting of Zn, Sn, Zr from 0.1 to 1.0 mass %, balance being Cu and inevitable impurities.

When Cr is added to Cu, Cr precipitates in Cu matrix to improve the strength and electrical conductivity. The precipitation is known to prevent from being softened by heating to improve heat resistance. With the Cr content below 0.1 mass %, the amount of the precipitation is too less to obtain the necessary strength. With the Cr content over 1.5 mass %, on the other hand, the precipitation is occurred which is not contributed to increase the strength at the time of casting or heat treatment (for example, solution treatment, age-treatment, annealing), thus not obtaining the strength matched to the added content, in addition, affecting wire drawing workability, bending workability.

The respective content of Zn, Sn and Cr when to be added is explained hereunder. Zn, Sn or Cr has effect to improve the strength, Sn plating heat resistance peeling property or the like. When to be added, total content of at least one element selected from the group consisting of Zn, Sn and Cr is from 0.1 to 1.0 mass %.

Zn improves heat resistance peeling property of Sn plating or soldering, and migration resistance. It is preferable to add at least 0.2 mass %. Considering the electrical conductivity, it is not favorable to add over 1.0 mass %.

Sn improves strength and stress resistance mitigation feature, as well as wire drawing workability. With the Sn content below 0.1 mass %, the effect of improving does not appear, on the other hand, with Sn content over 1.0 mass %, the electrical conductivity is lowered.

When Zr is added to Cu, Cu—Zr compound ($Cu_3Zr$ phase) is precipitated in the matrix of the Cu to improve the strength and electrical conductivity. With the Zr content below 0.1 mass %, the amount of the precipitation is too less to obtain the necessary strength. With the Zr content over 0.5 mass %, on the other hand, the effect is saturated and the cost of the material becomes expensive.

(Cu—Ti)

Cu—Ti copper alloy used in the copper alloy wire of the invention consists essentially of Ti from 1.0 to 5.0 mass %, balance being Cu and inevitable impurities.

It is known that when Ti is added to Cu, modulated structure occurs to improve the strength. With the Ti content below 0.1 mass %, the modulated structure is not sufficiently formed not to obtain necessary strength. With the Ti content over 5.0 mass %, on the other hand, it is not favorable because the workability is rapidly lowered and the wire drawing becomes difficult.

(Cu—Fe)

Cu—Fe copper alloy used in the copper alloy wire of the invention consists essentially of Fe from 1.0 to 3.0 mass %, balance being Cu and inevitable impurities, or the alloy consists essentially of Fe from 1.0 to 3.0 mass %, at least one elements selected from the group consisting of P and Zn from 0.01 to 1.0 mass %, balance being Cu and inevitable impurities.

It is known that when Fe is added to Cu, Fe precipitates in Cu matrix to improve the strength and electrical conductivity. It is also known that the precipitation is known to prevent from being softened by heating to improve heat resistance. With the Fe content below 1.0 mass %, the amount of the precipitation is too less to obtain the necessary strength. With the Fe content over 3.0 mass %, on the other hand, the precipitation is occurred which is not contributed to increase the strength at the time of casting or heat treatment (for example, solution treatment, age-treatment, annealing), thus not obtaining the strength matched to the added content, in addition, affecting wire drawing workability, bending workability.

The respective content of P and Zn when to be added is explained hereunder. P or Zn has effect to improve the strength, Sn plating heat resistance peeling property or the like. When to be added, total content of at least one element selected from the group consisting of P and Zn is from 0.01 to 1.0 mass %.

When P is added to Cu—Fe alloy, Fe—P compound is precipitated in the matrix of the Cu to improve the electrical conductivity. With the P content below 0.01 mass %, expected effect does not appear. With the P content over 0.2 mass %, on the other hand, the effect matched to be added is not obtained and workability thereof is deteriorated.

Cu—Ni—Ti alloy used in the copper alloy wire of the invention consists essentially of Ni from 1.0 to 2.5 mass %, Ti from 0.3 to 0.8 mass %, balance being Cu and inevitable impurities, or the copper alloy consists essentially of Ni from 1.0 to 2.5 mass %, Ti from 0.3 to 0.8 mass %, at least one elements selected from the group consisting of Ag, Mg, Zn and Sn from 0.01 to 1.0 mass %, balance being Cu and inevitable impurities.

When Ni and Ti are added to Cu, the Ni—Ti compound ($Ni_3Ti$ phase) precipitates in the Cu matrix to improve the strength and electrical conductivity. With the Ni content below 1.0 mass %, the amount of the precipitation is too less to obtain the necessary strength. With the Ni content over 2.5 mass %, on the other hand, cracks are likely produced at the time of casting, and the precipitation is occurred which is not contributed to increase the strength at the time of solution treatment, thus not obtaining the strength matched to the added content.

Since the precipitated Ni—Ti compound is considered to be $Ni_2Ti$ phase, the optimum Ti content to be added is decided based on the decided Ni content to be added. With the Ti content below 0.3 mass %, the sufficient strength is not obtained as same as the insufficient low content of Ni. With the Ti content over 0.8 mass %, on the other hand, the same problem as the excess Ni content occurs.

The respective content of Ag, Mg, Zn and Sn when to be added is explained hereunder. Ag, Mg, Zn or Sn has effect to improve the strength, Sn plating heat resistance peeling property or the like. When to be added, total content of at least one element selected from the group consisting of Ag, Mg, Zn and Sn is from 0.01 to 1.0 mass %.

Ag improves strength and heat resistance, and at the same time prevents the crystal grain size from coarsening to improve bending workability. With the Ag content below 0.01 mass %, the above effect is not sufficiently obtained. With the Ag content over 0.3 mass %, although bad effect does not appear, the cost becomes expensive. Thus, the content of Ag is from 0.01 to 0.3 mass %.

Mg improves stress resistance mitigation feature, but affects bending workability. From the stress resistance mitigation feature, the content of Mg is preferably at least 0.01 mass %, and more the better. On the other hand, from the bending workability, it is difficult to obtain excellent bending workability with the Mg content over 0.2 mass %. Thus, the content of Mg is from 0.01 to 0.2 mass %.

Zn improves heat resistance peeling property of Sn plating or soldering, and migration resistance. It is preferable to add at least 0.2 mass %. Considering the electrical conductivity, it is not favorable to add over 1.0 mass %.

Sn improves strength and stress resistance mitigation feature, as well as wire drawing workability. With the Sn content below 0.1 mass %, the effect of improving does not appear, on the other hand, with Sn content over 1.0 mass %, the electrical conductivity is lowered.

the elements which are within the above described ranges. More specifically, alloys Nos. 1 to 17 are prepared as the Cu—Ni—Si alloy, alloys Nos. 18 to 23 are prepared as the Cu—Cr alloy, alloys Nos. 24 to 26 are prepared as the Cu—Ti alloy, alloys Nos. 27 to 32 are prepared as the Cu—Fe alloy, and alloys Nos. 33 to 38 are prepared as the Cu—Ni—Ti alloy, respectively.

TABLE 1

| Alloy | Alloy composition(mass %) | | | | | | | | | | | | | |
|---|---|---|---|---|---|---|---|---|---|---|---|---|---|---|
| No. | Ni | Si | Ag | Mg | Mn | Zn | Sn | P | Fe | Cr | Co | Zr | Ti | Cu |
| 1 | 1.5 | 0.30 | | | | | | | | | | | | blance |
| 2 | 2.0 | 0.45 | | | | | | | | | | | | blance |
| 3 | 3.2 | 0.75 | | | | | | | | | | | | blance |
| 4 | 4.0 | 1.00 | | | | | | | | | | | | blance |
| 5 | 2.3 | 0.56 | 0.15 | | | | | | | | | | | blance |
| 6 | 2.2 | 0.55 | | 0.12 | | | | | | | | | | blance |
| 7 | 2.3 | 0.57 | | | 0.08 | | | | | | | | | blance |
| 8 | 2.3 | 0.54 | | | | 0.78 | | | | | | | | blance |
| 9 | 2.2 | 0.57 | | | | | 0.20 | | | | | | | blance |
| 10 | 2.3 | 0.53 | | | | | | 0.02 | | | | | | blance |
| 11 | 2.2 | 0.54 | | | | | | | 0.10 | | | | | blance |
| 12 | 2.3 | 0.55 | | | | | | | | 0.08 | | | | blance |
| 13 | 2.3 | 0.60 | | | | | | | | | 0.45 | | | blance |
| 14 | 2.3 | 0.56 | 0.10 | | | | 0.16 | | | | | | | blance |
| 15 | 2.2 | 0.55 | | 0.08 | 0.10 | | | | | | | | | blance |
| 16 | 2.3 | 0.56 | | 0.11 | | 0.46 | 0.13 | | | | | | | blance |
| 17 | 2.4 | 0.56 | 0.18 | | | 0.69 | | | 0.13 | | | | | blance |
| 18 | | | | | | | | | | 0.11 | | | | blance |
| 19 | | | | | | | | | | 0.92 | | | | blance |
| 20 | | | | | | | | | | 1.50 | | | | blance |
| 21 | | | | | | 0.12 | | | | 0.36 | | | | blance |
| 22 | | | | | | 0.26 | 0.28 | | | 0.29 | | | | blance |
| 23 | | | | | | | | | | 0.91 | | 0.22 | | blance |
| 24 | | | | | | | | | | | | | 1.2 | blance |
| 25 | | | | | | | | | | | | | 3.1 | blance |
| 26 | | | | | | | | | | | | | 4.9 | blance |
| 27 | | | | | | | | | 1.0 | | | | | blance |
| 28 | | | | | | | | | 2.2 | | | | | blance |
| 29 | | | | | | | | | 3.0 | | | | | blance |
| 30 | | | | | | | | 0.02 | 2.2 | | | | | blance |
| 31 | | | | | | 0.45 | | | 2.4 | | | | | blance |
| 32 | | | | | | 0.16 | | 0.09 | 2.30 | | | | | blance |
| 33 | 1.0 | | | | | | | | | | | | 0.31 | blance |
| 34 | 1.6 | | | | | | | | | | | | 0.50 | blance |
| 35 | 2.5 | | | | | | | | | | | | 0.78 | blance |
| 36 | 1.6 | | 0.10 | 0.09 | | | | | | | | | 0.49 | blance |
| 37 | 1.5 | | | 0.11 | | 0.49 | 0.13 | | | | | | 0.45 | blance |
| 38 | 1.5 | | 0.18 | | | 0.11 | | | | | | | 0.50 | blance |

In the above described Colson alloy (Cu—Ni—Si) wire, Cu—Cr alloy wire, Cu—Ti alloy wire, Cu—Fe alloy wire, and Cu—Ni—Ti alloy wire as the age-precipitation copper alloy wire, such element of the alloy as Ni, Si, Cr, Ti, Fe or the like is solid-soluble in the Cu matrix by the solution treatment. The compound $Ni_2Si$ is precipitated in the Cu—Ni—Si alloy, Cr is precipitated in the Cu—Cr alloy, Fe and Fe compound are precipitated in the Cu—Fe alloy, respectively by the age treatment to increase the strength. The Cu—Ti modulated structure is produced in the Cu—Ti alloy to increase the strength.

The above described temperature is the practical temperature, and the temperature can be estimated by the property and the flowing current. Furthermore, if the diameter of the wire is large, the temperature is measured by radiation thermometer. The temperature may be estimated by electrical conductivity.

The present invention is described in detail by examples.

Alloys No. 1 to 38 having respective ingredient composition as shown in Table 1 are prepared. All of the alloys have

Example 1

The alloys Nos. 1 to 38 are subjected to the solution treatment, and then the copper alloy wires having the diameter of 0.1 mm are formed. The copper alloy wires are continuously age-treated under the conditions as shown in Table 2 using the apparatus for manufacturing wire as depicted in FIGS. 3 and 4(*b*). The results are shown in Table 2. For comparison, the copper alloy wires having the diameter of 0.1 are formed using the above described alloys. The copper alloy wires are age-treated by the conventional method using the batch furnace. More specifically, the wires are heated to the temperature (degrees Celsius) as shown in Table 2, and held at the temperature for a time period of heating time (sec), and then wound by the wire winding equipment. The tensile strength (MPa) and electrical conductivity (% IACS) of the wire in the annealing while running equipment are shown in Table 2.

TABLE 2

| | Sample No. | Alloy No. | Temperature | Heating time (sec) | Tensile strength (MPa) | Electrical donductivity (% IACS) | Adhesion after aging |
|---|---|---|---|---|---|---|---|
| Samples of the invention | 1 | 1 | 500 | 900 | 571 | 60 | None |
| | 2 | 2 | 500 | 900 | 605 | 55 | None |
| | 3 | 3 | 500 | 900 | 673 | 44 | None |
| | 4 | 4 | 500 | 900 | 729 | 40 | None |
| | 5 | 5 | 500 | 900 | 635 | 52 | None |
| | 6 | 6 | 500 | 900 | 633 | 51 | None |
| | 7 | 7 | 500 | 900 | 637 | 49 | None |
| | 8 | 8 | 500 | 900 | 625 | 49 | None |
| | 9 | 9 | 500 | 900 | 647 | 50 | None |
| | 10 | 10 | 500 | 900 | 628 | 49 | None |
| | 11 | 11 | 500 | 900 | 630 | 42 | None |
| | 12 | 12 | 500 | 900 | 633 | 48 | None |
| | 13 | 13 | 500 | 900 | 678 | 47 | None |
| | 14 | 14 | 500 | 900 | 647 | 49 | None |
| | 15 | 15 | 500 | 900 | 636 | 47 | None |
| | 16 | 16 | 500 | 900 | 645 | 45 | None |
| | 17 | 17 | 500 | 900 | 640 | 35 | None |
| | 18 | 18 | 470 | 900 | 476 | 86 | None |
| | 19 | 19 | 470 | 900 | 484 | 85 | None |
| | 20 | 20 | 470 | 900 | 490 | 84 | None |
| | 21 | 21 | 470 | 900 | 485 | 84 | None |
| | 22 | 22 | 470 | 900 | 505 | 73 | None |
| | 23 | 23 | 470 | 900 | 512 | 82 | None |
| | 24 | 24 | 450 | 900 | 858 | 11 | None |
| | 25 | 25 | 450 | 900 | 874 | 11 | None |
| | 26 | 26 | 450 | 900 | 893 | 11 | None |
| | 27 | 27 | 450 | 900 | 467 | 73 | None |
| | 28 | 28 | 450 | 900 | 490 | 70 | None |
| | 29 | 29 | 450 | 900 | 534 | 67 | None |
| | 30 | 30 | 450 | 900 | 496 | 70 | None |
| | 31 | 31 | 450 | 900 | 514 | 64 | None |
| | 32 | 32 | 450 | 900 | 502 | 68 | None |
| | 33 | 33 | 570 | 900 | 685 | 54 | None |
| | 34 | 34 | 570 | 900 | 711 | 50 | None |
| | 35 | 35 | 570 | 900 | 752 | 48 | None |
| | 36 | 36 | 570 | 900 | 723 | 47 | None |
| | 37 | 37 | 570 | 900 | 740 | 45 | None |
| | 38 | 38 | 570 | 900 | 732 | 49 | None |
| Samples for comparison | 39 | 2 | 450 | 7200 | 599 | 57 | appeared |
| | 40 | 16 | 450 | 7200 | 642 | 48 | appeared |
| | 41 | 19 | 420 | 7200 | 498 | 88 | appeared |
| | 42 | 22 | 420 | 7200 | 500 | 75 | appeared |
| | 43 | 25 | 410 | 7200 | 868 | 12 | appeared |
| | 44 | 28 | 400 | 7200 | 486 | 73 | appeared |
| | 45 | 32 | 400 | 7200 | 495 | 70 | appeared |
| | 46 | 34 | 530 | 7200 | 705 | 53 | appeared |
| | 47 | 37 | 530 | 7200 | 731 | 49 | appeared |

As is clear from Table 2, according to the method of the invention, samples Nos. 1 to 38 (i.e., Cu—Ni—Si alloys Nos. 1 to 17, Cu—Cr alloys Nos. 18 to 23, Cu—Ti alloys Nos. 24 to 26, Cu—Fe alloys Nos. 27 to 32, Cu—Ni—Ti alloys Nos. 33 to 38) are subjected to sufficient age-treatment without adhesion after age-treatment. Contrary to the above, all the samples for comparison Nos. 39 to 47 (i.e., Cu—Ni—Si alloys Nos. 2 and 16, Cu—Cr alloys Nos. 19 and 22, Cu—Ti alloys No. 25, Cu—Fe alloys Nos. 28 and 32, Cu—Ni—Ti alloys Nos. 34 and 37) show adhesion after age-treatment.

Example 2

The example with the diameter of the copper alloy wire varied is shown. More specifically, alloy Nos. 16 and 22 as shown in Table 1 are subjected to solution treatment, and then the copper alloy wires having the diameters of 0.03 mm, 0.01 mm, 0.9 mm, 3 mm are formed, respectively. The copper alloy wires are continuously age-treated under the conditions as shown in Table 3 using the apparatus for manufacturing wire as depicted in FIGS. 3 and 4(*b*).

TABLE 3

| Sample No. | Alloy No. | Diameter (ϕ mm) | Temperature | Heating time (sec) | Tensile strength (MPa) | Electrical conductivity (% IACS) | Adhesion after aging |
|---|---|---|---|---|---|---|---|
| 51 | 16 | 0.03 | 480 | 900 | 639 | 44 | None |
| 52 | 16 | 0.1 | 500 | 900 | 645 | 45 | None |
| 53 | 16 | 0.9 | 500 | 900 | 634 | 44 | None |
| 54 | 16 | 3.0 | 500 | 900 | 621 | 44 | None |
| 55 | 22 | 0.03 | 450 | 900 | 502 | 73 | None |
| 56 | 22 | 0.1 | 470 | 900 | 505 | 73 | None |

TABLE 3-continued

| Sample No. | Alloy No. | Diameter (ϕ mm) | Temperature | Heating time (sec) | Tensile strength (MPa) | Electrical conductivity (% IACS) | Adhesion after aging |
|---|---|---|---|---|---|---|---|
| 57 | 22 | 0.9 | 470 | 900 | 498 | 73 | None |
| 58 | 22 | 3.0 | 470 | 900 | 483 | 72 | None |

As is clear from Table 3, all the samples Nos. 51 to 58 (i.e., Cu—Ni—Si alloys No. 16, Cu—Cr alloys No. 22) are subjected to necessary age-treatment without adhesion after age-treatment. More specifically, it is appreciated that the alloy wires having a diameter from 0.03 mm to 3 mm are subjected to continuous age-treatment.

Example 3

The same tests as Example 1 are carried out using the apparatus for manufacturing wire as shown in FIGS. 5, 6, and 8(*a*) in which the wire is heated by applying current while running for age-treatment. The center values of the temperatures of the age-treatment are respectively set to be the temperature as shown in Table 2 in Example 1. The difference between the maximum temperature and the minimum temperature is set to be 40 degrees. For example, the temperature of 500 degrees Celsius in Table 2 means that the center value of the temperature is set to be 500 degrees Celsius, the maximum temperature is set to be 520 degrees Celsius, and the minimum temperature is set to be 480 degrees Celsius.

As a result, the samples of the present Example which correspond to the samples Nos. 1 to 38 in Table 2 of Example 1 show the same result as those of the samples in Examples 1 in connection with the tensile strength (MPa) and electrical conductivity (% IACS) of the wire in the annealing while running equipment without adhesion after age-treatment. More specifically, it is appreciated that the wire is age-treated by heating through applying current while running in the present Example.

In the present example, it is appreciated that when the difference between the maximum temperature and the minimum temperature for age-treatment is within 50 degrees Celsius, the age-treatment by heating through applying current while running is effectively carried out in the same manner as the age-treatment by continuous annealing. The smaller difference between the maximum temperature and the minimum temperature is preferable in view of improving the obtained property of the copper alloy wire. In order to attain the above, it is necessary to shorten the time period for each heating by applying current, and the time period for each no heating, thus, the number of heating equipment 20 by applying current for maintaining temperature increases. The difference between the maximum temperature and the minimum temperature for age-treatment is preferably decided considering the required property of the copper alloy wire and restriction of the equipment.

Other Example

All the embodiments of the apparatus for manufacturing wire as depicted in FIGS. 4 and 8 are explained. The conditions are as follows:

(1) Age-precipitation copper alloys used for the copper alloy wire are alloy Nos. 16 and 22 as shown in Table 1.

(2) Diameters of the wire in case of the single wire are four kinds of 0.03 mm, 0.1 mm, 0.9 mm and 3 mm. The cases in which the apparatus for manufacturing wire except those shown in FIGS. 4(*c*), 4(*f*), 8(*b*) and 8(*e*) are used correspond to the above condition of the diameter.

(3) Seven single wires are twisted to form a twisted wire. The diameters of the single wire are three kinds of 0.03 mm, 0.1 mm and 0.9 mm. The cases in which the apparatus for manufacturing wire shown in FIGS. 4(*c*), 4(*f*), 8(*b*) and 8(*e*) are used correspond to the above condition of the diameter.

(4) The wire having a diameter of 5 mm is heated at the temperature from 800 to 950 degrees Celsius for a time period of from 0.1 to 5 second, and then rapidly cooled by a water cooling mechanism (not shown) for solution treatment. The cases in which the apparatus for manufacturing wire shown in FIGS. 4(*c*), 4(*f*), 8(*b*) and 8(*e*) are used correspond to the above condition.

(5) In case of wire-drawing after solution treatment, the diameters of the wire after the wire drawing are four kinds of 0.03 mm, 0.1 mm, 0.9 mm and 3 mm.

(6) Conventional covering equipment is used. The wire is covered by polyethylene.

As a result, the followings are acknowledged in the examples using all embodiments of the apparatus for manufacturing wire as shown in FIGS. 4 and 8.

(A) The substantially same result was obtained for the single wire as those shown in Tables 2 and 3. Necessary age-treatment was applied to the copper alloy wire and no adhesion occurred.

(B) As for the twisted wire, the substantially same result was obtained for the single wire forming the twisted wire as those shown in Tables 2 and 3. Necessary age-treatment was applied for each single wire and no adhesion between the single wires occurred.

(C) All the solution treatment, the wire drawing and the covering were continuously carried out with the age-treatment. In addition, necessary age-treatment was applied for the copper alloy wire and no adhesion between the copper alloy wires occurred.

As described above, according to the method for manufacturing wire of the invention, it is possible to carry out aging heat treatment by continuous annealing. Since the annealing while running equipment (heating while running equipment) can be installed in tandem with various continuous equipment (for example, wire twisting equipment, covering equipment, drawing equipment), the number of the processes can be reduced. In addition, when a current applying equipment for exclusively solution purpose (solution treating equipment) is installed in tandem at upstream side of the annealing while running equipment (heating while running equipment), it becomes possible to continuously perform solution-aging process. Furthermore, with the drawing equipment installed before or after the annealing while running equipment (heating while running equipment), it becomes possible to continuously perform solution-drawing-aging process, solution-aging-drawing process, solution-drawing-aging-drawing process, thus obtaining various kinds of materials. Furthermore, since no batch furnace is necessary to apply age-treatment after manufacturing the wire, no adhesion of the wires occurs after age-treatment, thus improving quality of the obtained wire, and yield ratio thereof.

What is claimed is:

1. A method for manufacturing wire, comprising:

providing an age-precipitation copper alloy wire selected from a group consisting of Cu—Ni—Si, Cu—Cr, Cu—Ti, Cu—Fe, and Cu—Ni—Ti;

applying a solution treatment to said wire by applying current to said wire to generate Joule heat to heat said wire to a temperature of at least 800 degrees Celsius for a time period of up to 5 seconds;

applying a heating process to said wire, said heating process including:

passing said wire through a first current applying region, followed by a no current applying region, and followed by a second current applying region, pre-heating said wire to a temperature between an upper limit of aging temperature and a lower limit of aging temperature in said first current applying region to start an aging treatment by applying current to said wire to generate Joule heat to heat said wire to a temperature within a prescribed temperature range of 300 degrees Celsius to 600 degrees Celsius within 5 seconds, lowering a temperature of said wire in said no current applying region to a temperature above said lower limit of aging temperature such that, when said wire enters said second current applying region, said temperature of said wire is above said lower limit of aging temperature, and heating said wire to a temperature between said upper limit of aging temperature and said lower limit of aging temperature in said second current applying region by applying current to said wire to generate Joule heat to heat said wire to a temperature within said prescribed temperature range, wherein said wire holds a temperature for applying said aging treatment within said prescribed temperature range, in said first and second current applying regions and the no current applying region, for a prescribed time period of over 10 seconds to 1200 seconds, and said passing through said no current applying region and said second current applying region includes turning said wire around a plurality of times while maintaining said wire within said prescribed temperature range; and winding said wire to which said aging treatment has been applied.

2. The method according to claim 1, wherein said wire has a diameter of 0.03 mm to 3 mm.

3. The method according to claim 1, wherein said wire comprises a twisted wire.

4. The method according to claim 1, wherein said wire is rapidly cooled by liquid immediately after being heated, by said solution treatment, to said temperature of at least 800 degrees Celsius.

5. The method according to claim 4, wherein said temperature of said solution treatment is within a range of 800 to 950 degrees Celsius.

* * * * *